US006038417A

United States Patent [19]

Nagamine et al.

[11] Patent Number: 6,038,417

[45] Date of Patent: Mar. 14, 2000

[54] IMAGE FORMING APPARATUS WITH COVER LIFTING MECHANISM

[75] Inventors: Tomoyuki Nagamine; Yukio Saito; Tsutomu Nagatomi; Hirofumi Nakayasu; Youji Houki, all of Kawasaki, Japan

[73] Assignee: Fujitsu Limited, Kawasaki, Japan

[21] Appl. No.: 09/391,356

[22] Filed: Sep. 8, 1999

Related U.S. Application Data

[62] Division of application No. 09/050,112, Mar. 30, 1998, Pat. No. 5,978,626.

[30] Foreign Application Priority Data

Nov. 20, 1997 [JP] Japan ..... 9-319842

[51] Int. Cl.[7] ..... G03G 15/00; G03G 21/16; G03G 15/01

[52] U.S. Cl. ..... 399/125; 347/116; 399/301; 399/303

[58] Field of Search ..... 399/125, 299, 399/300, 301, 303, 9; 347/215, 139, 262, 264, 116

[56] References Cited

U.S. PATENT DOCUMENTS

| | | | |
|---|---|---|---|
| 4,416,536 | 11/1983 | Itoh et al. | 399/128 |
| 4,761,662 | 8/1988 | Yoshimoto et al. | 347/262 X |
| 5,200,781 | 4/1993 | Hata | 399/125 |
| 5,323,210 | 6/1994 | Inomata | 399/113 |
| 5,333,036 | 7/1994 | Koga | 399/111 |
| 5,379,092 | 1/1995 | Takashima | 399/125 |
| 5,587,769 | 12/1996 | Sawada et al. | 399/113 |
| 5,765,082 | 6/1998 | Numazu et al. | 399/299 |
| 5,784,676 | 7/1998 | Iseki et al. | 399/301 |

FOREIGN PATENT DOCUMENTS

| | | |
|---|---|---|
| 9-160333 | 6/1997 | Japan . |

*Primary Examiner*—Susan S. Y. Lee
*Attorney, Agent, or Firm*—Armstrong, Westerman, Hattori, McLeland & Naughton

[57] ABSTRACT

The image forming apparatus includes a frame, a top cover pivotally mounted to the frame, a lock member for locking the top cover onto the frame, a plurality of printing assemblies, a fixing device, and a paper conveyor belt. Each of the printing assemblies having a photosensitive body, a charger, an optical head for forming an electrostatic latent image on the photosensitive body, a developing device, and a transfer element. An optical sensor is used to read marks formed on the paper conveyor belt. The top cover opens an optical passage of the optical sensor when the apparatus is in operation and shuts off the optical passage when the apparatus is not in operation.

8 Claims, 25 Drawing Sheets

IMAGE FORMING APPARATUS WITH COVER LIFTING MECHANISM

This application is a division of prior application Ser. No. 09/050,112 filed Mar. 30, 1998, U.S. Pat. No. 5,978,626.

BACKGROUND OF THE INVENTION

1. Field of the Invention

The present invention relates to an image forming apparatus, including a plurality of printing assemblies arranged in series, intended to make a multi-color record.

2. Description of the Related Art

The image forming apparatus of the electrostatic recording type comprises a photosensitive body (photosensitive drum), a charger, an optical head for forming an electrostatic latent image on the photosensitive body, a developing device for developing the electrostatic latent image into a toner image, and a transfer element (transfer roller) for transferring the toner image onto paper. The charger, the optical head, the developing device and the transfer element are arranged to surround the photosensitive body to form a charged toner image while the photosensitive body rotates one revolution. The charged toner image is transferred from the photosensitive body onto paper by a transfer element, and the paper is then sent to a fixing device and is discharged.

The photosensitive body, the charger, the optical head, the developing device and the transfer element constitute a printing assembly. The image forming apparatus capable of making a multi-color record comprises a plurality of printing assemblies each including a photosensitive body, a charger, an optical head, a developing device and a transfer element. When, for example, developing agents of four colors, i.e., yellow, magenta, cyan and black are to be used, the image forming apparatus is equipped with four printing assemblies containing respective developing agents. The image forming apparatus of the tandem type in which a plurality of printing assemblies are arranged in series, is particularly effective in executing printing at high speed.

The paper is conveyed through the plurality of printing assemblies arranged in series, and a fixing device arranged after the assemblies, by a paper conveyer belt. The toner images formed by the printing assemblies of the respective colors are superposed on the paper to form a color image. In order to bring the printing positions into agreement, the printing assemblies print positioning marks on the paper conveyer belt, and an optical sensor reads the marks printed on the paper conveyer belt. Based on the marks thus read out, the printing positions and the printing timings of the plurality of printing assemblies can be adjusted.

The image forming apparatus is further equipped with a top cover which is rotatably mounted on the frame. Upon opening the top cover, the interior of the frame becomes accessible. That is, upon opening the top cover, the constituent members of the print assemblies arranged inside the frame can be repaired or replaced. In particular, the toner must be replenished as it decreases in the developing device. It is desired that the toner can be replenished with ease. Usually, the top cover is locked to the frame by a lock member, and is opened by hand after the locking of the lock member is released.

In the image forming apparatus of the electrostatic recording type, one print assembly includes a photosensitive body, a charger, an optical head, a developing device and a transfer element. The photosensitive body, the charger and the developing device are detachably mounted to the frame as a developing unit. The optical head is mounted to the top cover. When the top cover is opened, therefore, the optical head is lifted together with the top cover. Thus, the user is allowed to access the developing device and so on, and the manufacturer is allowed to maintain the optical heads.

In the image forming apparatus equipped with a plurality of printing assemblies, a plurality of optical heads are mounted to the top cover, and the developing units are detachably mounted to the frame. Moreover, the top cover includes a control board for controlling the optical heads, sheet metal for shielding the control board, and a base frame for mounting the optical heads and the control board. Therefore, the top cover is very heavy. Besides, the image forming apparatus has been designed to be capable of effecting the printing even on large papers and, hence, employs large constituent members, causing the top cover to become even heavier. If the top cover becomes heavier, it is difficult for the operator to lift the top cover. Besides, many constituent members must be efficiently arranged in the limited space in the interior of the apparatus.

A laser beam must not be allowed to leak to the exterior when the top cover is opened. A laser beam which leaks in unexpected directions when the top cover is opened may enter the eyes of the operator. This is not desirable.

SUMMARY OF THE INVENTION

The object of the present invention is to provide an image forming apparatus which enables a top cover to be easily opened and closed, and enables the interior of the frame to be easily accessible upon opening the top cover, facilitating the replacement of expendables and the maintenance and testing of the apparatus.

Another object of the present invention is to provide an image forming apparatus in which the constituent members are efficiently arranged inside the frame.

A further object of the present invention is to provide an image forming apparatus capable of shutting off the optical passage of the optical reading unit when the apparatus is not in use.

The image forming apparatus, according to the present invention comprises a frame, a top cover movably mounted to the frame, a lock member for locking the top cover to the frame, a cover lifting mechanism for lifting the cover by a predetermined amount relative to the frame when the lock member is released, a plurality of print assemblies for forming images of different colors, a fixing device, and a paper conveyer belt for conveying paper through the plurality of printing assemblies and the fixing device. Each of the printing assemblies comprises a photosensitive body, a charger for charging the photosensitive body, an optical head for forming an electrostatic latent image on the photosensitive body, a developing device for developing the electrostatic latent image into a toner image, and a transfer element for transferring the toner image onto a paper, the optical head being mounted to the top cover.

Owing to this constitution, the top cover is lifted up by a predetermined amount relative to the frame by the cover lifting mechanism when the lock member is released. The predetermined amount will be, for example, a distance which permits fingers to be inserted between the frame and the top cover. Therefore, the operator is allowed to easily open the top cover using finger pressure.

The following constitution can be employed together with the above-mentioned constitution.

Provision is made of a switch which is linked to the cover lifting mechanism to detect the opening or closure of the top cover.

The apparatus has a front end and a rear end, the fixing device is disposed near the rear end of the apparatus, and the top cover is mounted to turn about a rotary support point disposed at a position on the rear side of the fixing device.

The cover lifting mechanism is disposed near the front end of the apparatus, and comprises a rod engageable with the top cover, a spring for urging the rod in a direction in which the top cover opens, and a stopper for stopping the rod at a predetermined position.

The photosensitive body, the charger and the developing device in each of the printer assemblies are formed as a developing unit, and the frame has a resin guide for positioning the optical head and the developing unit independently for each of the print assemblies.

The angle of the optical head when the top cover is closed is set to lie over a range of from 91 to 120 degrees with respect to the horizontal from the side of the rotary support point.

The photosensitive body, the charger and the developing device in each of the printing assemblies are formed as a developing unit, and the frame has a guide which permits the developing unit to be attached or detached at an angle over a range of from 1 to 45 degrees with respect to the horizontal from the side of the front end.

The frame has a support portion having a recessed shape for receiving the tip of the optical head when the top cover is closed, the support portion being located at a position nearly in agreement with the surface of the photosensitive body.

The frame has a turn-stop portion for receiving a side portion of the optical head when the tip of the optical head is supported by the support portion, and further has an urging means for urging the optical head toward the turn-stop portion.

The top cover has side plates, the frame has side plates, the rotary support point is provided on the side plates of the top cover and the side plates of the frame, and the side plates of the top cover have protuberances that come into contact with the side plates of the frame.

The side plates of the frame have ridged portions that come into contact with the protuberances of the side plates of the top cover.

The rugged portions are formed at a position where the top cover is held in a fully opened condition.

The rugged portions are so formed that the protuberances on the side plates of the top cover will not ride over the rugged portions despite of the gravity of the top cover.

Provision is further made of an end cover located above the fixing device, the end cover being linked to the top cover.

The end cover remains at a closed position until the top cover is lifted from the closed position to a partially open position and opens, by being linked to the top cover, when the top cover is lifted from the partially open position to the fully opened position.

The present invention further provides an image forming apparatus comprising a closing cover mounted to the frame so as to be opened and closed, a plurality of printing assemblies each comprising a photosensitive body, a charger for charging the photosensitive body, an optical head for forming an electrostatic latent image on the photosensitive body, a developing device for developing the electrostatic latent image into a toner image, and a transfer element for transferring the toner image onto paper, a fixing device, a paper conveyer belt for conveying paper through the plurality of print assemblies, an optical sensor having a light-emitting element and a light-receiving element to read marks formed on the paper conveyer belt, and a movable cover which opens an optical passage of the optical sensor when the apparatus is in operation and shuts off the optical passage of the optical sensor when the apparatus is not in operation.

According to this constitution, since the movable cover is provided with a shut-off for shutting off the optical passage of the optical sensor, the laser beam does not leak to the exterior even though a portion of the apparatus is opened.

The following constitutions can be employed together with this constitution.

The optical sensor includes a laser diode and a photodiode.

The optical sensor includes a dust-preventing member which permits the transmission of detection light but prevents the infiltration of dust and dirt.

The movable cover includes a cleaning member capable of cleaning the dust-preventing member.

The movable cover is urged by an urging member toward a direction to shut off the optical passage.

The optical sensor has a plurality of detector units, and the movable cover is capable of simultaneously covering the plurality of detector units.

The optical sensor is retracted from the paper conveyer belt being linked to the movable cover.

The optical sensor is supported in a floating manner by the frame.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
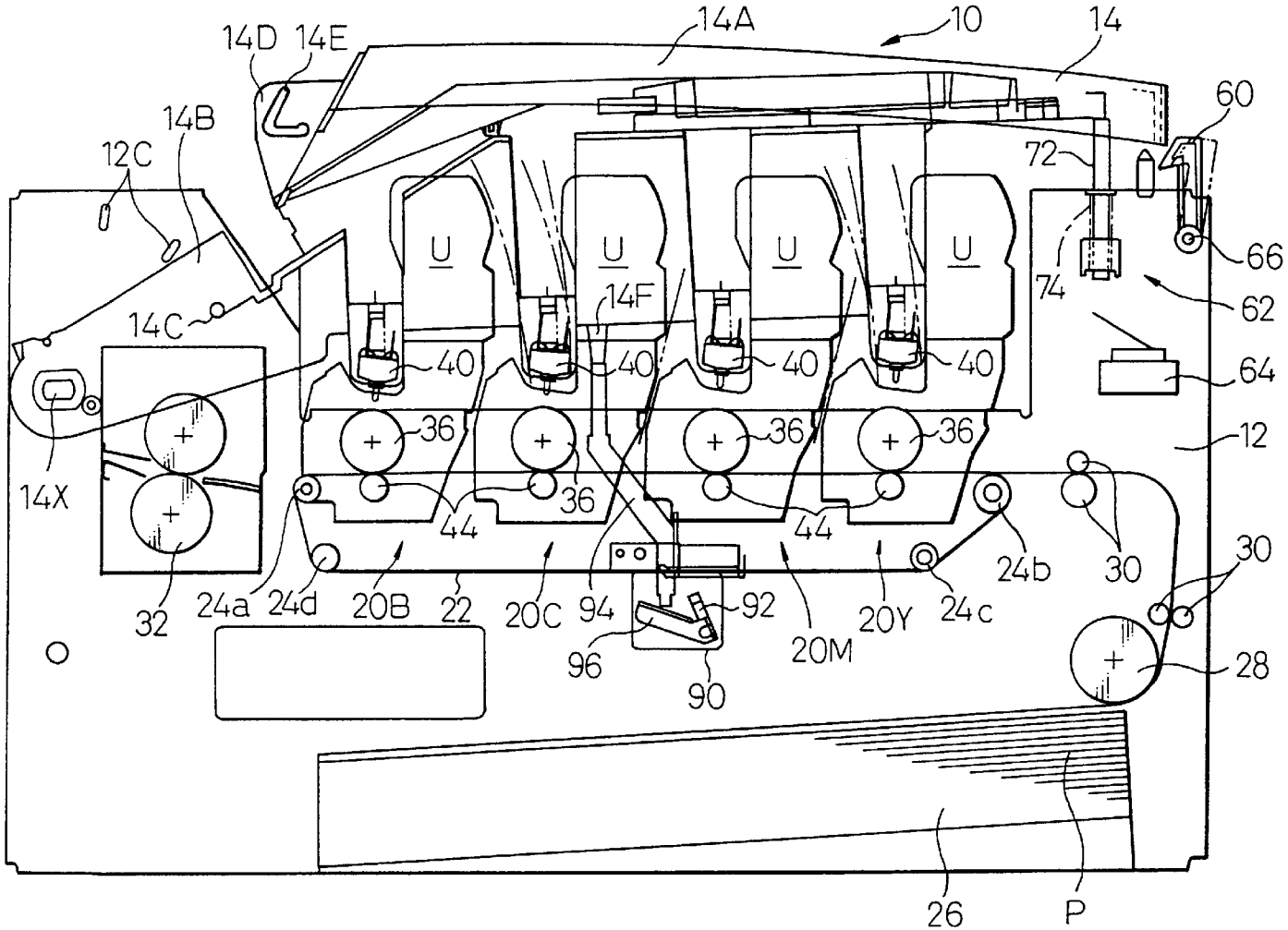
FIG. 1 is a side view schematically illustrating an image forming apparatus according to the embodiment of the present invention, a top cover being at a slightly opened position.
Figure 2:
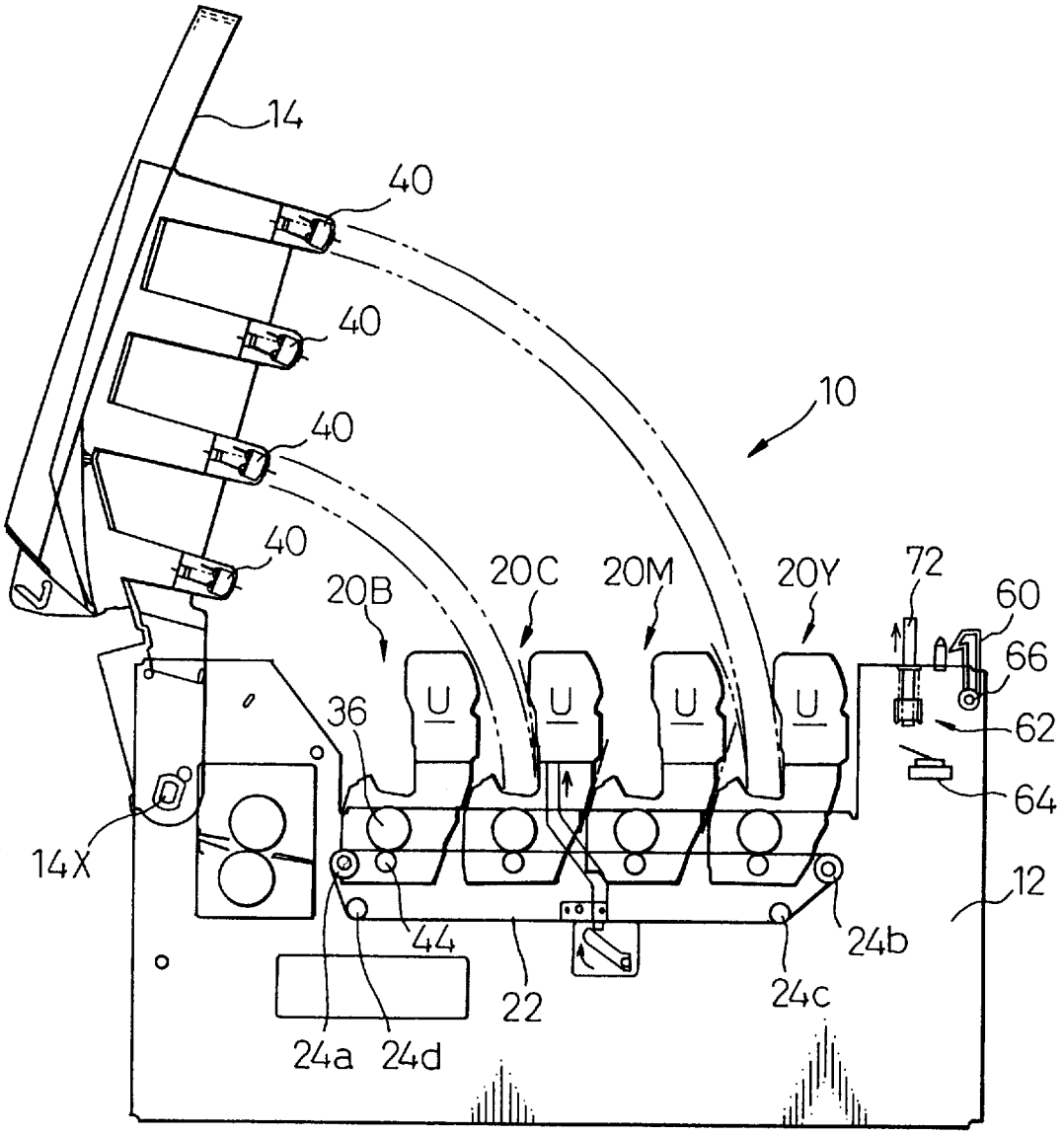
FIG. 2 is a view illustrating the image forming apparatus in which the top cover is at the fully opened position.
Figure 4:
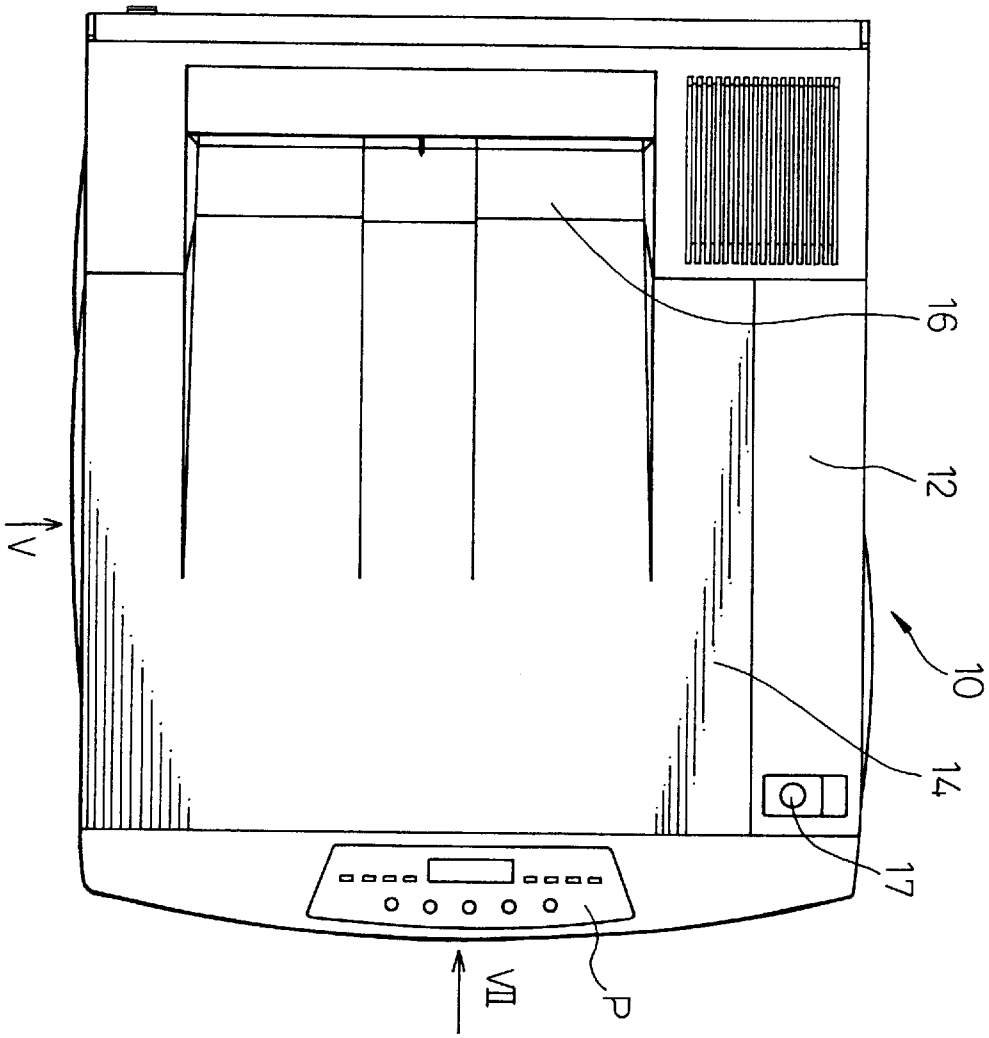
FIG. 4 is a plan view illustrating the image forming apparatus in which the top cover is at the closed position relative to the frame.
Figure 5:
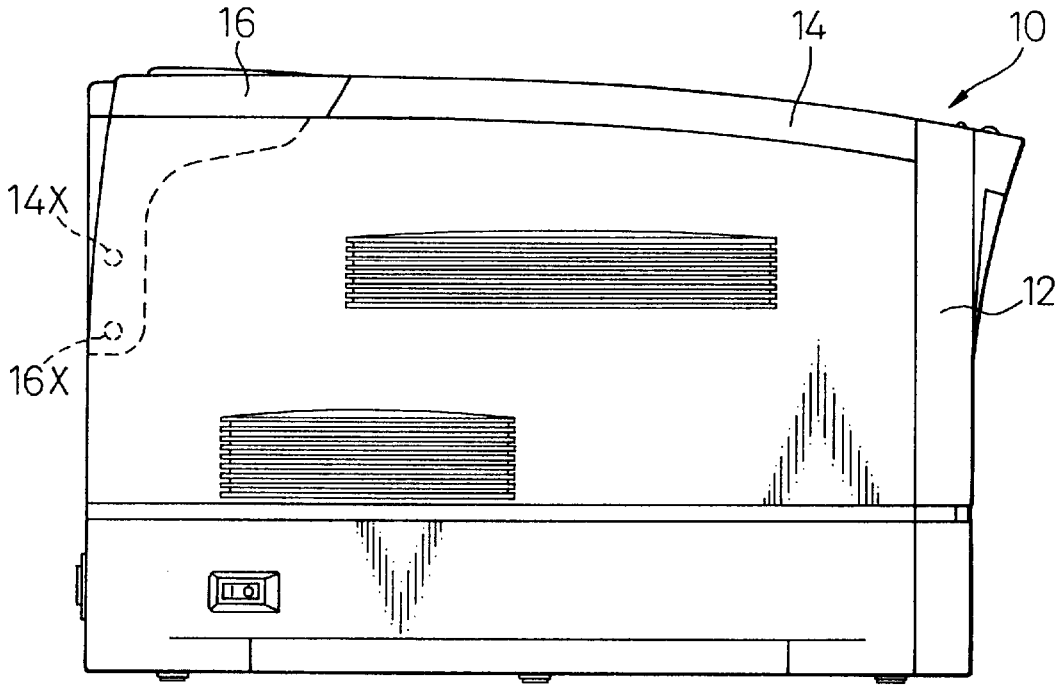
FIG. 5 is a side view of the image forming apparatus of FIG. 4.

FIGS. 1 and 2 illustrate an image forming apparatus 10 according to the embodiment of the present invention. The image forming apparatus 10 is constituted as a full color printer. The image forming apparatus 10 has a frame 12 which includes a top cover 14 and a rear cover 16. The rear cover 16 is not shown in FIGS. 1 and 2 but is shown in FIGS. 4 and 5. FIG. 1 illustrates the top cover 14 is at a slightly opened position with respect to the frame 12, and FIG. 2 illustrates the top cover 14 at the fully opened position with respect to the frame 12. Upon opening the top cover 14 and/or the rear cover 16, the members inside the image forming apparatus 10 become accessible.

FIG. 4 is a plan view illustrating the image forming apparatus in which the top cover 14 is closed with respect to the frame 12, and FIG. 5 is a side view of the image forming apparatus 10 of FIG. 4. The image forming apparatus 10 includes an operation panel P at the right end of FIG. 4. In the drawings, the right end where the operation panel P exists is the front side of the apparatus, and the left end is the rear side of the apparatus. A lock-releasing button 17 of the top frame 14 exists on the front side of the apparatus. The rear cover 16 exists at an end on the side opposite to the operation panel P.

Figure 6:
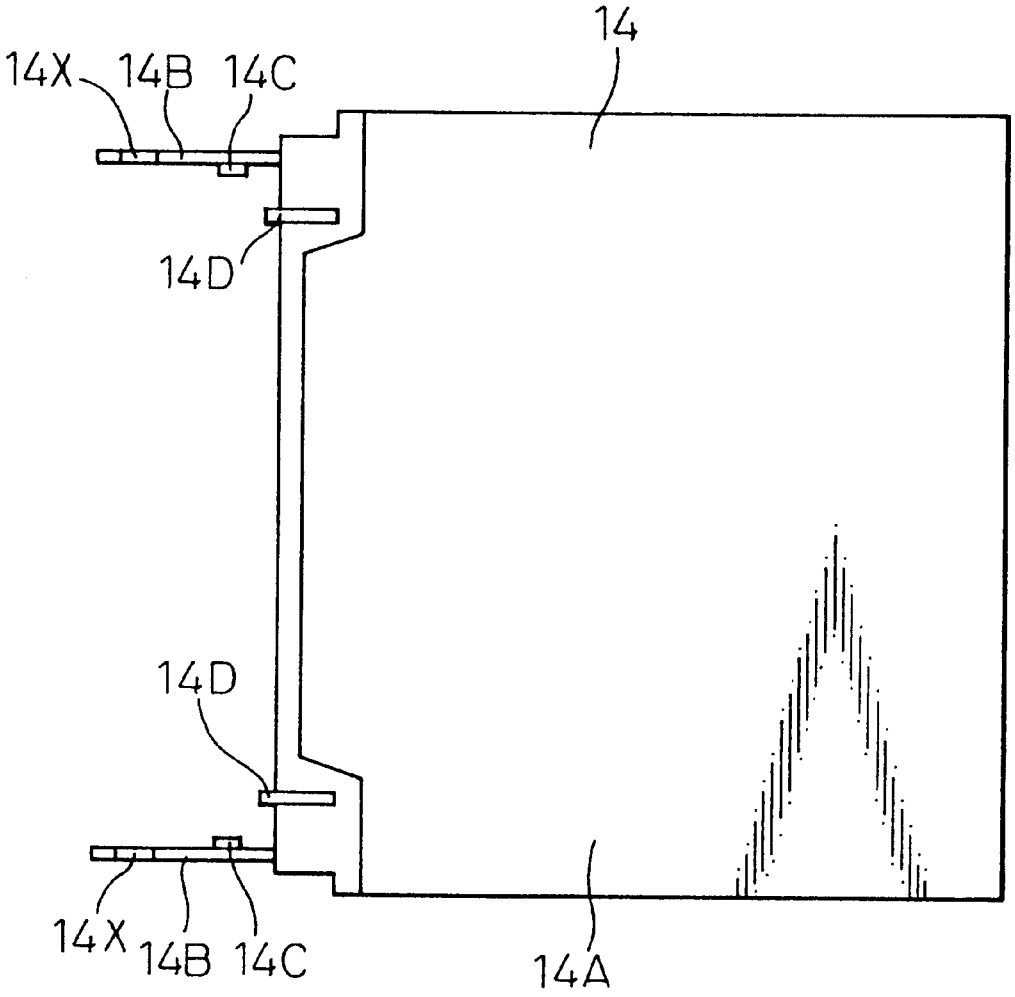
FIG. 6 is a plan view illustrating the top cover.

FIG. 6 is a plan view of the top cover 14. As shown in FIGS. 1 and 6, the top cover 14 has a so-called cover portion 14A and side plate portions 14B that extend rearward and downward from both sides of the cover portion 14A. In FIG. 5, furthermore, the top cover 14 can pivotally move about a rotation support point 14X located at a rear portion of the apparatus, and the rear cover 16 can pivotally move about a rotary support point 16X located under the rotary support point 14X. In FIG. 6, the rotary support point 14X is shown as holes formed in the side plate portions 14B. A rotary support shaft is inserted in the holes formed in the side plate portions 14B. FIGS. 1 and 2 show the rotary support point 14X but does not show the rotary support point 16X.

In FIGS. 1 and 2, the image forming apparatus 10 includes four printing assemblies 20B, 20C, 20M and 20Y arranged in series. An endless paper conveyer belt 22 is provided for the four printing assemblies 20B, 20C, 20M and 20Y. The paper conveyer belt 22 is formed of a suitable transparent synthetic resin material, and runs around four rollers 24*a*, 24*b*, 24*c* and 24*d*. The roller 24*a* is a drive roller which also works as an AC electric charge-removing roller for removing electric charge from the paper conveyer belt 22. The roller 24*b* is a driven roller which also works as a charging roller for imparting an electric charge to the paper conveyer belt 22. The rollers 24*c* and 24*d* are both guide rollers, the roller 24*d* being a tension roller for imparting a suitable tension to the paper conveyer belt 22.

A hopper 26 is provided under the paper conveyer belt 22. A stack of papers P is stored in the hopper 26. The papers P are delivered one by one from the hopper 26 by a pick roller 28, and are conveyed onto the paper conveyer belt 22 by a paper feed roller 30. The paper P is conveyed by the paper conveyer belt 22 to the printing assemblies 20B, 20C, 20M and 20Y and printing or recording is effected thereat. The recorded paper P is conveyed to a fixing device 32, and is discharged to a stacker formed on the upper surface of the top cover 14 through suitable guide rollers (not shown).

The paper conveyer belt 22 is electrically charged by the driven roller 24*b*. Therefore, the paper P that is introduced onto the paper conveyer belt 22 from the side of the driven roller 24*b* is electrostatically attract and held by the paper conveyer belt 22. Accordingly, the paper P is held maintaining a predetermined positional relationship with respect to the paper conveyer belt 22. On the other hand, the drive roller 24*a* works as the electric charge-removing roller and, hence, the electric charge is removed at the time the paper P passes the position of the drive roller 24*a;* i.e., the paper P being discharged from the side of the drive roller 24*a* is not entrained in the lower running portion of the paper conveyer belt 22 and is easily separated away from the paper conveyer belt 22.

The four printing assemblies 20Y, 20M, 20C and 20B have identical structures. The printing assembly 20Y contains a developing agent having a yellow toner component, and the printing assembly 20M contains a developing agent having a magenta toner component. The printing assembly 20C contains a developing agent having a cyan toner component, and the print assembly 20B contains a developing agent having a black toner component. Therefore, these printing assemblies 20Y, 20M, 20C and 20B print a yellow toner image, a magenta toner image, a cyan toner image and a black toner image onto the paper P, that moves while being held by the paper conveyer belt 22, to thereby form a resultant full-color toner image.

Figure 3:
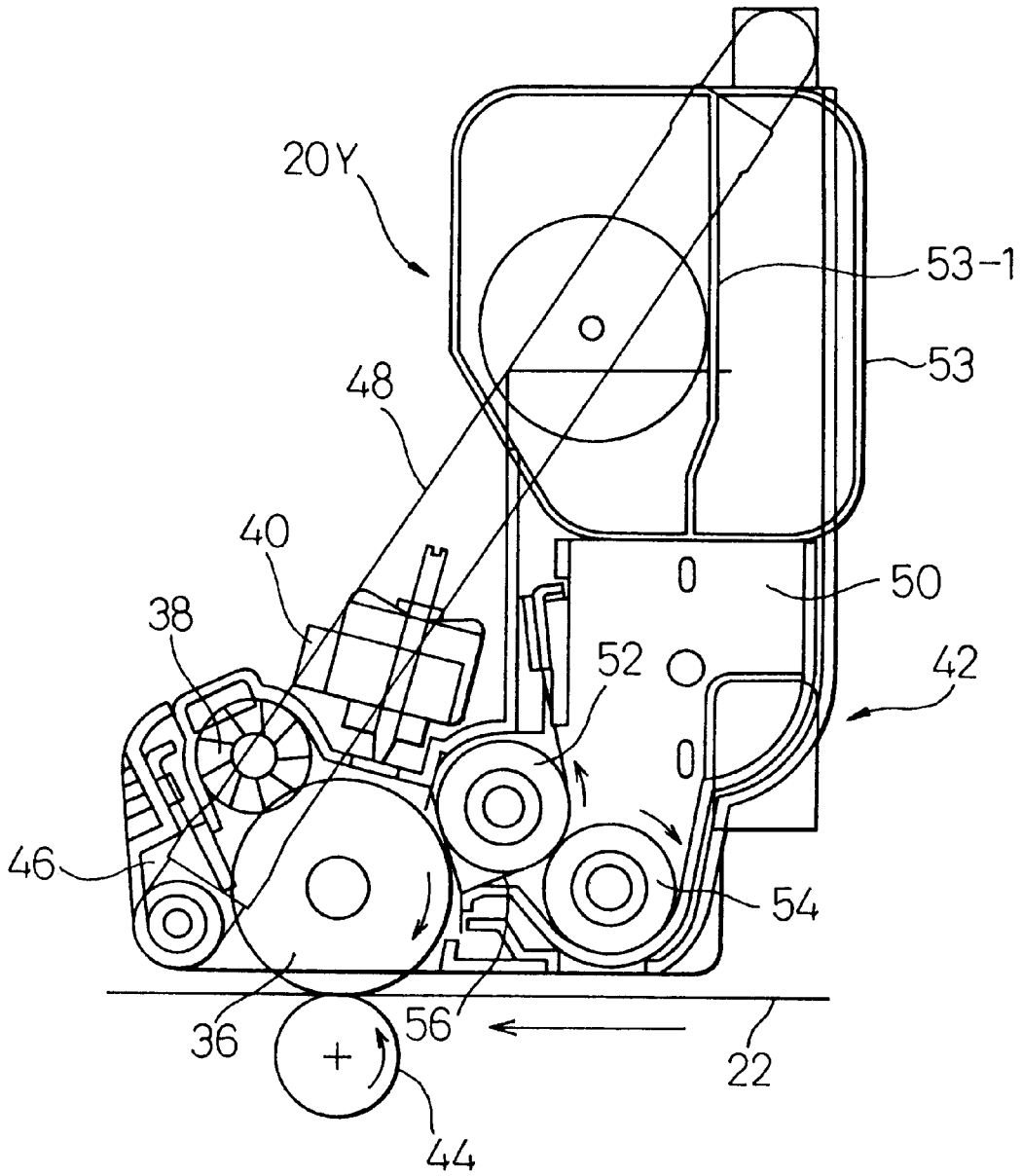
FIG. 3 is a view illustrating one printing assembly.

FIG. 3 illustrates one printing assembly 20Y. Other printing assemblies 20M, 20C and 20B have the same constitution as that of the printing assembly 20Y. Therefore, the printing assembly 20Y only will be described in detail. The printing assembly 20Y is equipped with a photosensitive body (photosensitive drum) 36 which is rotated in the direction of the arrow in FIG. 3. A precharger 38, an optical head (LED beam scanner) 40, a developing device 42, a transfer element (transfer roller) 44, and a toner-cleaning device 46 are arranged in this order to surround the photosensitive body 36.

The precharger 38 disposed above the photosensitive body 36 is, for example, a corona charger or a scorotron charger. Due to the precharger 38, the surface of the photosensitive body 36 is continuously charged with a uniform electric charge. The optical head 40 is disposed after the precharger 38, and writes an electrostatic latent image onto the electrically charged region of the photosensitive body 36 using an LED beam. In other words, the LED beam is energized based on binary image data obtained from a computer or a word processor, so that the electrostatic latent image is written as dot images.

The electrostatic latent image written onto the photosensitive body 36 is electrostatically developed into an electrically charged toner image using a toner of a predetermined color in the developing device 42. The electrically charged toner image is electrostatically transferred onto the paper P by the transfer element 44 located under the photosensitive body 36. The transfer element 44 is formed as an electrically conducting transfer roller made of a porous material (sponge). The transfer element 44 is urged against the photosensitive body 36 via the paper conveyer belt 22, and gives an electric charge of a polarity opposite to that of the electrically charged toner image to the paper P conveyed by the paper conveyer belt 22, whereby the electrically charged toner image on the photosensitive body 36 is electrostatically transferred from the photosensitive body 36 onto the paper P.

The paper P onto which the electrically charged toner image is transferred is liberated from the paper conveyer belt 22 and is sent toward the fixing device 32. The toner that was not transferred onto the paper P remains adhered to the surface of the photosensitive body 36 after the transfer onto the paper P is finished. The residual toner is removed by the toner-cleaning device 46. The residual toner that is removed is returned back to the developing device 42 by a toner returning device constituted by a screw conveyer 48 and the like, and is used again as the toner for developing.

In FIG. 3, the developing device 42 is equipped with a developing agent container 50 for containing a one-component developing agent comprising a toner (fine powdery particles of a colored resin). In the port of the developing agent container 50 is arranged a magnet roller or a developing roller 52 in a manner that a portion of the surface thereof is exposed. The developing roller 52 comprises a shaft/core portion supported by the two side walls of the developing agent container 50 and a sleeve disposed to rotate about the periphery of the core portion and is formed of a nonmagnetic material such as aluminum. When the developing device 42 is in operation, the sleeve of the developing roller 52 rotates in the direction indicated by the arrow in the drawings.

A toner hopper 53 is provided on the developing agent container 50 so as to be detachably mounted thereon. A toner is contained in the toner hopper 53. When the toner in the developing agent container 50 is depleted, the toner in the toner hopper 53 is supplied into the developing agent container 50. When the toner is supplied to the developing agent container 50 and is depleted in the toner hopper 53, this fact is informed as an error to the outside of the apparatus. The toner is replenished by replacing an old toner hopper 53 containing no toner by a new toner hopper 53 filled with the toner. The interior of the toner hopper 53 is divided into two sections by a wall 53-1. The one portion is filled with the new toner before the toner hopper is mounted, and the other portion is in an empty state. When the toner hopper 53 is mounted to the apparatus, the waste toner recovered by the toner-cleaning device 46 is recovered through a recovery pipe 48 and is contained in the empty portion of the toner hopper 53. Upon replacing the toner hopper 53, therefore, the new toner is replenished while discarding the waste toner. The recovery pipe 48 is provided with a screw by which the toner is conveyed.

When the developing device 42 is installed in the apparatus, the exposed surface of the developing roller 52, i.e., the sleeve, is opposed to the surface of a carrier which carries the electrostatic latent image such as the photosensitive body. The bottom wall of the developing agent container 50 serves as a developing agent reservoir in which a reset roller 54 is provided. The reset roller 54 is rotatably supported by both side walls of the developing agent container 50, and is rotated in the direction indicated by the arrow in the drawing when the developing device 42 is in operation. The reset roller 54 recovers the developing agent that was not supplied to the photosensitive body 36 but remains on the developing roller 52.

With the rotation of the developing roller 52, the developing agent is conveyed to the region opposed to the photosensitive body 36, i.e., conveyed to the developing region. A developing agent-limiting blade 56 is provided under the developing roller 52, while being opposed thereto, in order to limit, to a predetermined value, the amount of the developing agent conveyed by the developing roller 52 to the developing region.

The developing device 42 executes the following developing process. When, for example, the toner component in the developing agent is electrically charged to a negative polarity, a uniformly charged region of the negative polarity is formed on the rotary surface of the photosensitive body 36 due to the precharger 38. When the electrically charged region of the photosensitive body 36 is irradiated with an LED beam emitted from the optical head 40, the electric charge of the negative charge escapes from the irradiated portion giving rise to the occurrence of a potential difference. That is, the electrostatic latent image is written as a potential difference onto the electrically charged region of the photosensitive body 36. For example, when the electrically charged region of the photosensitive body 36 has a potential of −600 volts, the potential of the electrostatic latent image drops to about −15 volts. On the other hand, a negative developing bias voltage of, for example, −400 volts is applied to the developing roller 52, and an electric field is formed between the developing roller 52 and the photosensitive body 36. Due to the electric field formed between the developing roller 52 and the photosensitive body 36, the toner component charged into the negative polarity flies toward the photosensitive body 36, adheres onto the photosensitive body 36 and the image is developed.

As shown in FIG. 1, therefore, the paper P is introduced from a portion of the driven roller 24*b* of the belt conveyer means 10 into the printing region, and passes through the printing assemblies 20Y, 20M, 20C and 20B, successively, whereby toner images of four colors are formed in an overlapped manner on the paper P to thereby form a full-color image. The paper P is, then, sent toward the heat roller-type thermal fixing device 32 from the side of the drive roller 24*a* of the belt conveyer means 10, and the full-color image is thermally fixed on the paper P there.

The photosensitive body 36, the charger 38, the developing device 42 and the toner-cleaning device 46 are formed as a developing unit U in each of the printing assemblies 20Y, 20M, 20C and 20B. Each developing unit U is detachably mounted to the frame 12. The optical head 40 is mounted to the top cover 14. The paper conveyer belt 22 and the rollers 24*a* to 24*d* are jointly formed as a belt unit, and the transfer element 44 is mounted to the belt unit.

By opening the top cover 14, the constituent elements of the printing assemblies can be repaired or replaced. Moreover, the end cover 16 is disposed at a position to cover the fixing device 32. Upon opening the end cover 16, the fixing device 32 can be repaired or replaced. As shown in FIGS. 1 and 2, the rotary support point 14X of the top cover 14 is located at a position behind the fixing device 32. Therefore, the top cover 14 has an increased length and, as shown in FIG. 2, the radii of rotation of the optical heads 40 increase while the top cover 14 turns, making it possible to decrease the dead space in the frame 12 that is required for the optical heads 40 to turn. Concretely speaking, the gap between the two neighboring developing units U can be decreased.

The top cover 14 includes the four optical heads 40, the control board for controlling the optical heads 40, the sheet metals for shielding the control board, the base frames for mounting the optical heads 40, etc. and is very heavy. It is therefore desired to provide means by which the top cover 14 can be easily opened.

Referring to FIGS. 1 and 2, the image forming apparatus 10 includes a lock member 60 for locking the top cover 14 to the frame 12, a cover lifting mechanism 62 for lifting the top cover 14 relative to the frame 12 when the lock member 60 is released, and a switch 64 linked to the cover lifting mechanism 62 to detect the opening or closing of the top cover 14.

Figure 7:
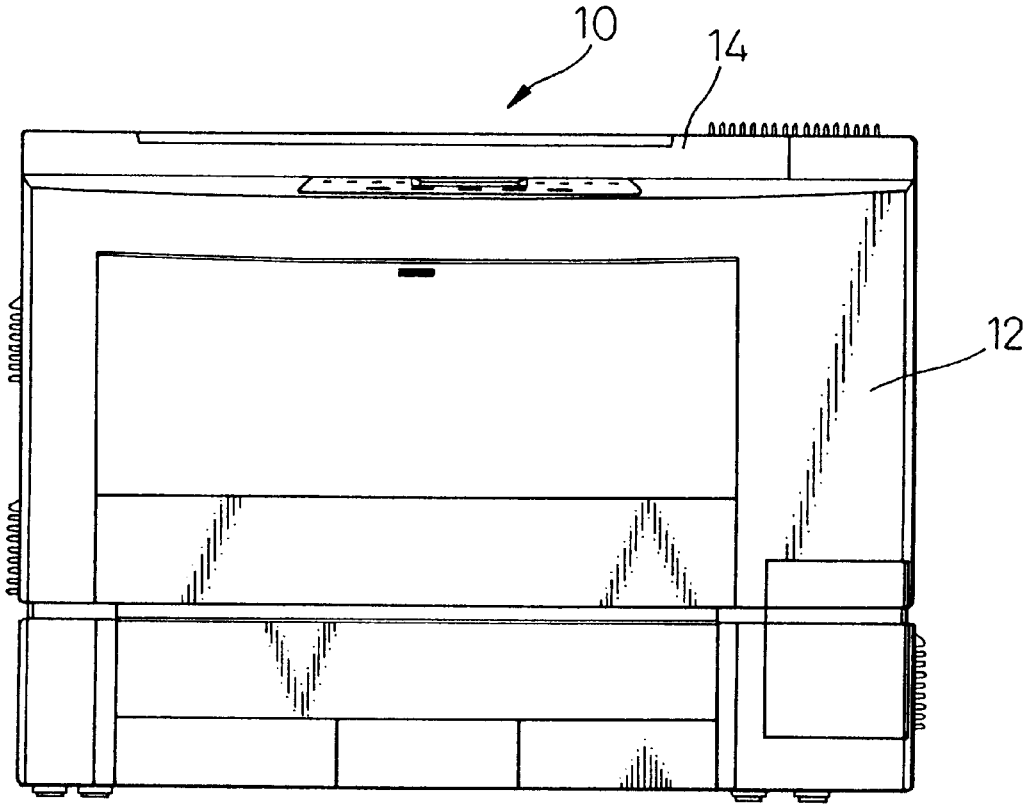
FIG. 7 is a front view the image forming apparatus, viewed in the direction of the arrow VII in FIG. 4.
Figure 8:
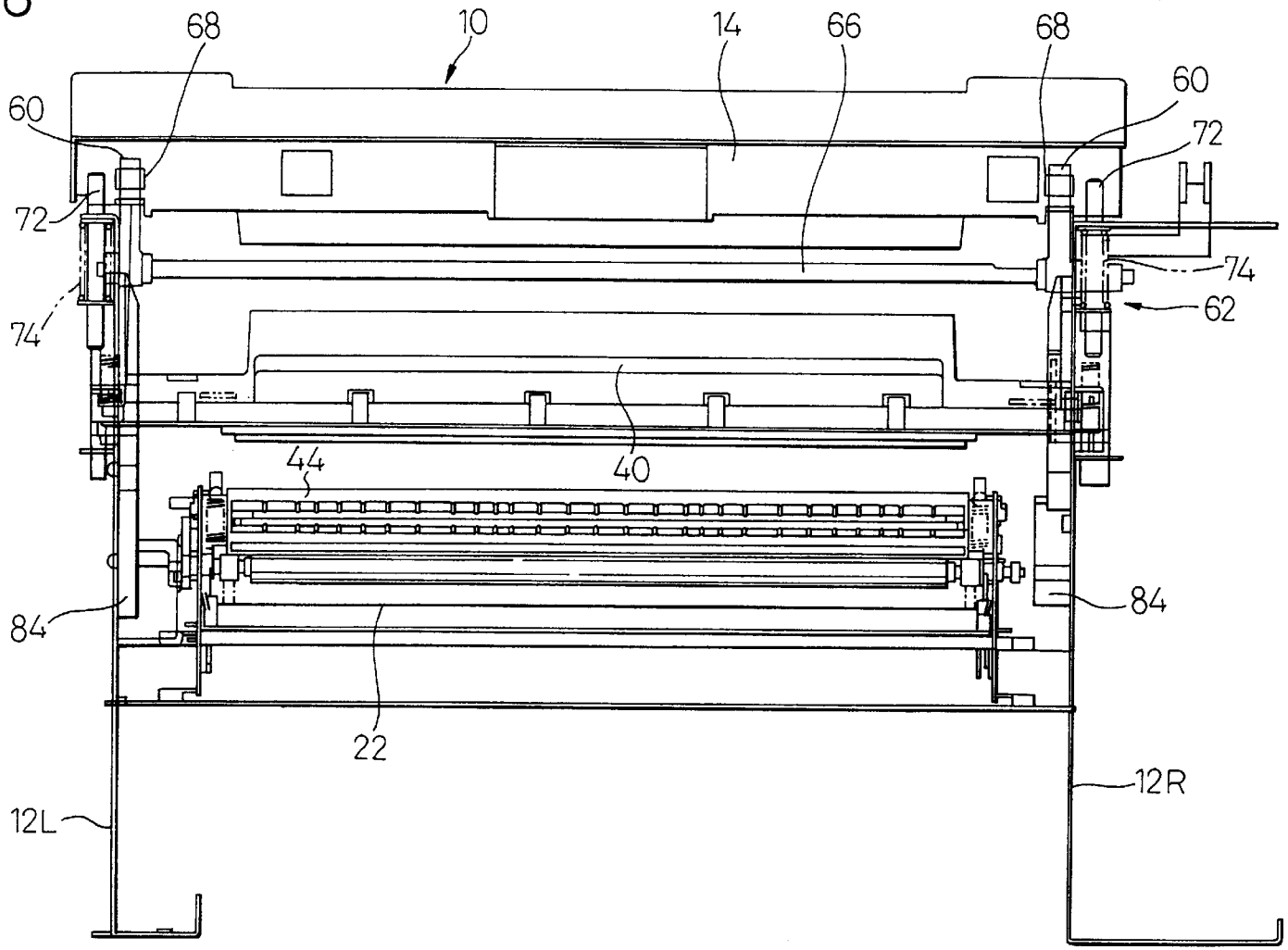
FIG. 8 is a front view showing the interior of the image forming apparatus, with the front wall member removed from the frame in FIG. 7.
Figure 9:
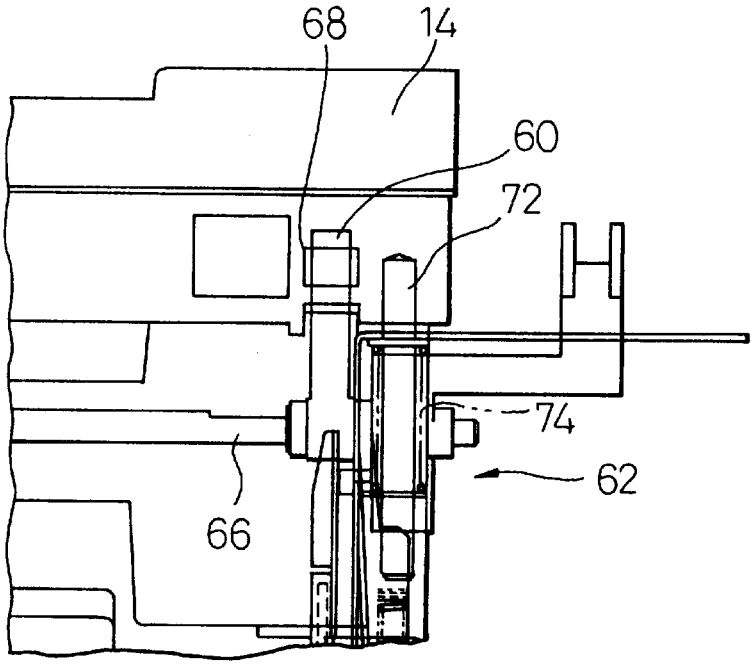
FIG. 9 is a front view, on an enlarged scale, of a portion of the image forming apparatus of FIG. 8.
Figure 10:
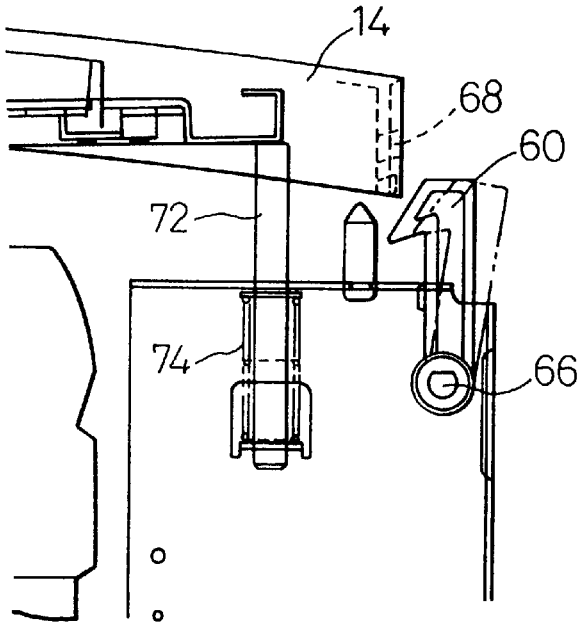
FIG. 10 is a side view of the image forming apparatus of FIG. 9 when the top cover is opened by a predetermined amount.

FIG. 7 is a front view of the image forming apparatus 10 seen from the direction of the arrow VII in FIG. 4, FIG. 8 is a view illustrating the interior of the image forming apparatus 10 with the front wall removed from the frame 12 in FIG. 7, and FIGS. 9 and 10 are views illustrating portions of the image forming apparatus 10 of FIG. 7 on an enlarged scale. As shown in these views (and particularly in FIG. 8), two lock members 60 are arranged on both sides at the front end of the apparatus and mounted to a support shaft 66. The frame 12 has a left-side frame member 12L and a right-side frame member 12R, and the support shaft 66 is supported by these side frame members 12L and 12R. The lock members 60 have hooked tips as shown in FIGS. 1, 2 and 10. Lock holes 68 are formed in the front surface of the top cover 14. The top cover 14 is locked to the frame 12 when the hooked tips of the rock members 60 have engaged in the lock holes 68 in the top cover 14.

Figure 12:
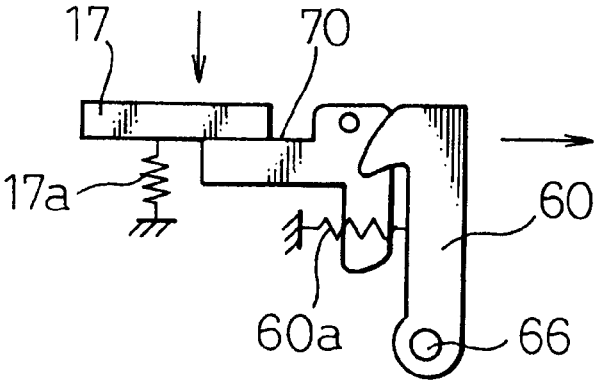
FIG. 12 is a view illustrating the operational relationship between the lock releasing button and the lock member of FIGS. 1 and 2.

FIG. 12 is a view illustrating the operational relationship between the lock-release button 17 and the lock member 60. The lock-release button 17 is disposed so that it can be downwardly depressed, and is urged by a spring 17*a* to return upwards. An intermediate lever 70 is disposed between the lock-release button 17 and the lock member 60. When the lock-release button 17 is depressed, the intermediate layer 70 turns causing the lock member 60 to turn clockwise as indicated by the arrow in the drawing, whereby the hooked tip of the lock member 60 is disengaged from the lock hole 68 in the top cover 14, and the top cover 14 is released from the frame 12. The two lock members 60 move together with the support shaft 66. A spring 60*a* urges the lock member 60 toward the locking position.

Figure 11A:
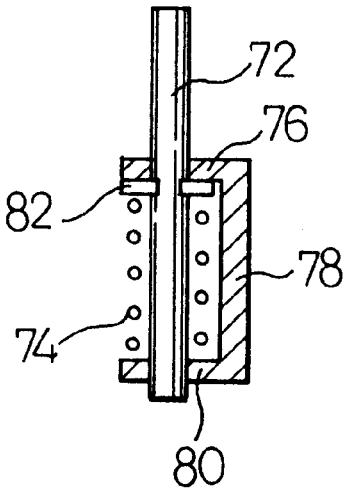
FIGS. 11A and 11B are views illustrating the cover lifting mechanism of FIGS. 1 and 2.
Figure 11B:
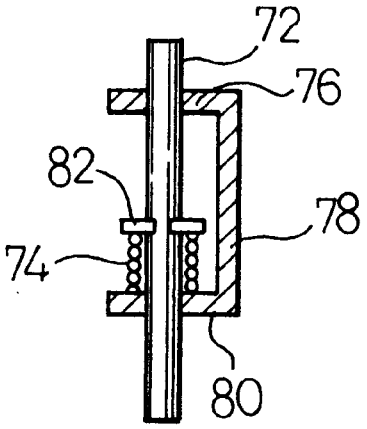

FIGS. 11A and 11B are views illustrating the cover lifting mechanism 62. In FIGS. 11A and 11B and in the above-mentioned drawings, the cover lifting mechanism 62 is disposed near the front end of the apparatus and includes a rod 72 capable of engaging with the top cover 14, a spring 74 for urging the rod 72 in the direction in which the top cover 14 opens, and a stopper 76 for stopping the rod at a predetermined position. In FIGS. 11A and 11B, the angle-like bracket 78 is secured to the frame 12, the upper wall of the bracket 78 serves as the stopper 76, and the lower wall of the bracket 78 serves as a spring seat 80. The rod 72 has a retaining ring 82 fitted in a groove formed therein. The spring 74 is disposed around the rod 72 between the stopper 76 and the spring seat 80.

The tip of the rod 72 comes into contact with a predetermined portion of the top cover 14 as shown in FIG. 10. When the top cover 14 is closed by hand, the top cover 14 pushes the rod 72 down against the spring 74, so that the lock members 60 lock the top cover 14. The rod 72 moves from the position of FIG. 11A to the position of FIG. 11B. When the top cover 14 is opened, the lock-release button 17 is depressed and the lock members 60 are moved via the intermediate lever 70 so that the lock members 60 are disengaged from the lock holes 68 and the top cover 14 is unlocked from the frame 12. Then, the rod 72 moves upwards due to the action of the spring 74 to thereby force the top cover 14 to open. The upward motion of the rod 72 stops at a position where the retaining ring 82 comes into contact with the stopper 76.

The stroke of the rod 72 may be such that a gap is formed between the top cover 14 and the frame 12 to permit fingers to be inserted therein, so that the top cover 14 can be easily opened by hand. Concretely speaking, the top cover 14 may be lifted by more than 10 mm.

FIG. 1 illustrates the image forming apparatus 10 under this state. In the state of FIG. 1, therefore, it is possible to insert a hand under the top cover 14 to a sufficient degree, so that the top cover 14 can be fully opened by hand. FIG. 2 illustrates the image forming apparatus 10 in which the top cover 14 is at the fully opened position.

A force for lifting the top cover 14, other than the cover lifting mechanism 62, may exist. For example, the top cover 14 may include urging springs for positioning the optical heads 40 and urging springs for positioning the developing units U, that will be described later, but these springs are not capable of lifting the top cover 14 by a predetermined amount when the top cover 14 is unlocked. The urging springs for the developing units U do not act when the developing units U are removed. The cover lifting mechanisms 62 may be provided in a plural number. The top cover 14 can be reliably lifted up with a small force when the cover lifting mechanism 62 is disposed at the front end of the top cover 14.

The switch 64 is disposed in a passage where the rod 72 of the cover lifting mechanism 62 moves, and is turned on or off by the rod 72. The switch 64 is connected to a control circuit that is not shown and turns off the power source for predetermined parts in the frame 12 when the top cover 14 is opened. When the top cover 14 is closed, the power source is turned on for the predetermined parts in the frame 12. The switch of any other type (e.g., a microswitch, a transmission type switch or the like) can be used in addition to the switch 64 that is shown.

Arranging the rotation pivot 14X of the top cover 14 at the rear part of the apparatus, as described above, makes it possible to reduce a dead space required for turning (pivoting) the optical heads 40 mounted to the top cover 14 and, hence, to effectively and compactly arrange the plurality of printing assemblies 20B, 20C, 20M and 20Y. If the rotation pivot 14X of the top cover 14 is located between the fixing device 32 and the final printing assembly 20B, the radii of turn of the optical heads 40 decrease, resulting in an increase in a dead space due to the turn of the optical heads 40.

Figure 13:
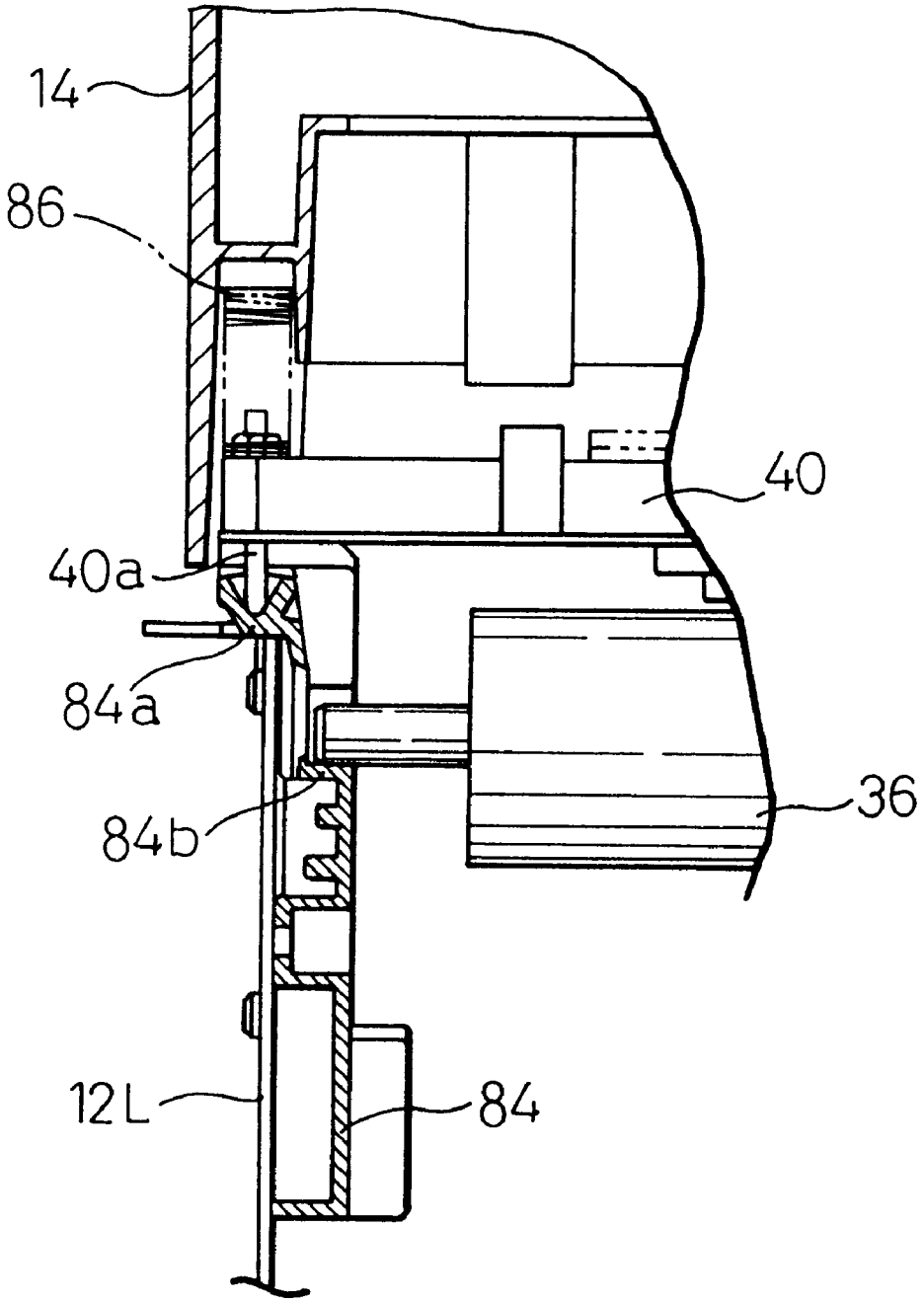
FIG. 13 is a cross-sectional view illustrating a portion of the apparatus of FIG. 8 on an enlarged scale.

FIG. 13 is a view illustrating a portion of the apparatus of FIG. 8 on an enlarged scale. In FIGS. 8 and 13, the frame 12 has the left-side frame member 12L and the right-side frame member 12R as described above. The photosensitive body 36, the charger 38 and the developing device 42 are formed as a developing unit U in each printing assembly, and each of the side frame members 12L and 12R has a resin guide member 84 for positioning the optical head 40 mounted to the top cover 14 and the developing unit U independently for each of the printing assemblies. Upon providing the resin guide member 84 for each of the printing assemblies, it is allowed to form the guide member 84 in a smaller size than that when the similar guide member is commonly provided for all printing assemblies, and the amount of thermal deformation due to a rise in temperature caused by the heat of fixing and printing can be suppressed to be smaller than that when the guide member 84 is formed in a large size. In each printing assembly, therefore, the constituent members are reliably positioned and maintain a predetermined positional relationship. Decreasing the thermal deformation is effective in preventing the deviation in positions of the light-emitting portions of the optical heads 40.

Referring to FIG. 13, the optical head 40 has its own mounting frame, and the mounting frame has a pin-like tip 40*a*. The guide member 84 has a recessed (conical) support portion 84*a* for receiving the pin-like tip 40*a* of the mounting frame of the optical head 40. The optical head 40 is downwardly urged by a spring 86 relative to the top cover 14. When the top cover 14 is closed, the pin-like tip 40*a* of the optical head 40 is brought into reliable contact with the recessed support portion 84*a*. The spring 86 upwardly urges the top cover 14 through the optical head 40. Here, however, the spring 86 is not strong enough to produce a force and a movement to substantially open the top cover 14 when the lock member 60 is released.

The guide member 84 has a bearing 84*b* for receiving the shaft of the photosensitive body 36. Therefore, the optical head 40 and the photosensitive body 36 are positioned by the common guide member 84. The charger 38 and the developing device 42 are formed as a developing unit U together with the photosensitive body 36. Therefore, these members, too, are positioned by the guide member 84.

Figure 14:
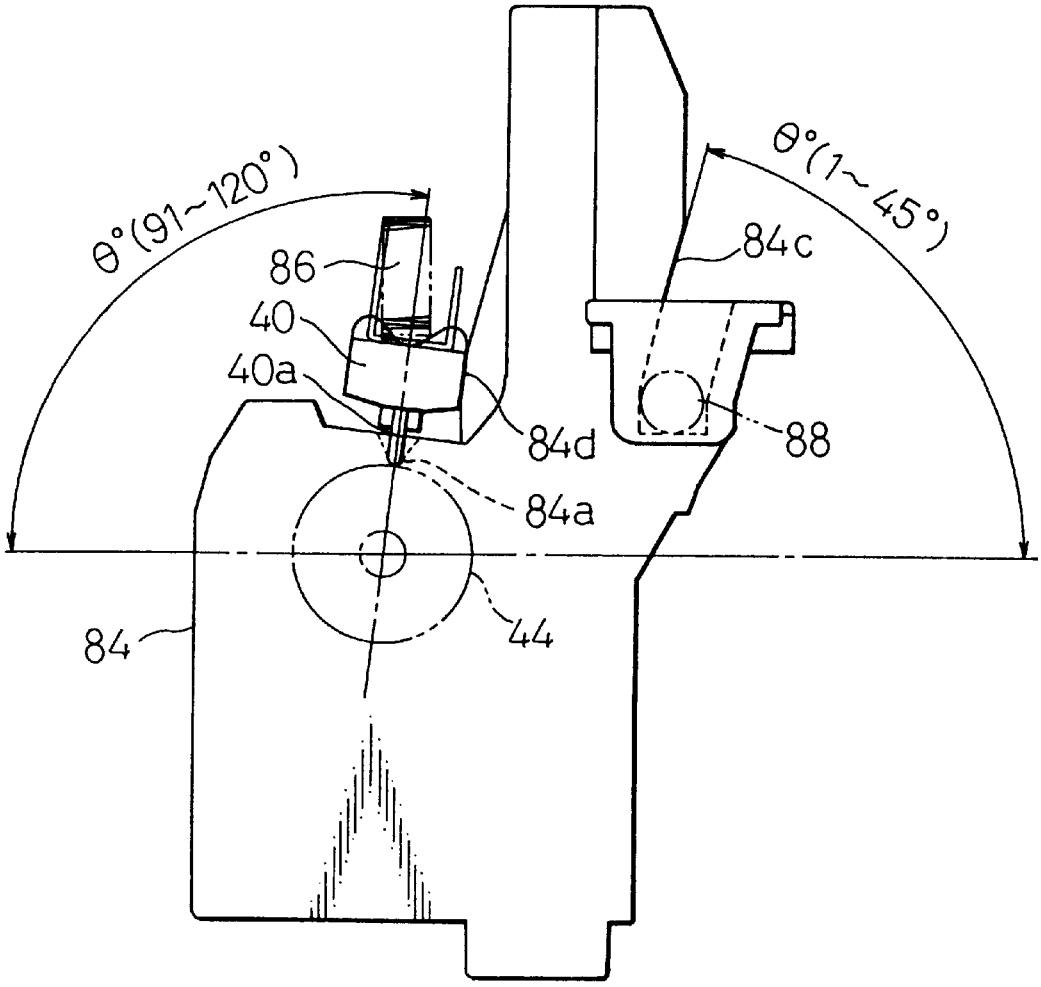
FIG. 14 is a side view of a portion of the apparatus of FIG. 13.

FIG. 14 is a side view of the apparatus of FIG. 13, and shows the above-mentioned optical head 40, the photosensitive body 36 and the guide member 84. The guide member 84 further has a guide portion (guide groove) 84*c*. The developing unit U has its own mounting frame (not shown) for supporting the above-mentioned constituent members, and the mounting frame has a unit-positioning pin 88. When the developing unit U is to be mounted to the frame 12 of the image forming apparatus 10, the shaft of the photosensitive body 36 is brought into contact with the bearing 84*b* while moving the unit-positioning pin 88 along the guide portion 84*c*.

As shown in FIG. 14, the support portion 84*a* is provided at such a position that the tip 40*a* of the optical head 40 comes nearly into agreement with the surface of the photosensitive body 36 that is supported by the bearing 84*b*. Accordingly, the tip 40*a* of the optical head 40 is positioned to be nearly in agreement with the surface of the photosensitive body 36 at all times, and a predetermined positional relationship is maintained between the light-emitting portion of the optical head 40 and the surface of the photosensitive body 36. Even in the case where the optical head 40 is deviated in the direction of rotation due to vibration or the like, a predetermined relationship is maintained between the surface of the photosensitive body 36 and the focal distance of the LED portion of the optical head 40 at all times, making it possible to accomplish favorable printing. The optical head 40 is in a floating condition with reference to the positioning point.

As shown in FIG. 2, when the top cover 14 is closed, the optical head 40 moves toward the guide 84 describing an arcuate locus and is supported by the recessed support portion 84*a* in the guide 84. At a position where the optical head 40 is supported by the recessed support portion 84*a* of the guide 84 as shown in FIG. 14, the optical head 40 is located being tilted at an angle of from 91 to 120 degrees with respect to the horizontal from the side of the rotary support point 14X. This helps decrease the dead space for turning the optical head 40 mounted to the top cover 14, and it is allowed to arrange the plurality of printing assemblies effectively and compactly. When the optical head is located at 90 degrees, dead space increases due to the locus of turn. Space can be effectively utilized particularly when a wider optical head 40 is used.

The guide portion 84*c* of the guide member 84 permits the developing unit U to be detachably attached at an angle over a range of 1 to 45 degrees with respect to the horizontal from the side of the front end. This enables the neighboring two printing assemblies to be arranged at a smaller pitch. Besides, the developing units U need not be attached or detached in the order from an end but, instead, the developing unit U at any position can be attached or detached while the other developing units U are being attached. Since the developing unit U is attached or detached in the tilted position toward the operator side, it provides a good attaching or detaching operability. The printing assemblies are arranged being overlapped by each other so that they can be effectively mounted. When it is attempted to attach or detach the developing unit U located at the center with the printing assemblies being arranged in an overlapped manner, the central printing assembly may interfere with the front and rear printing assemblies and often cannot be removed. According to the present invention, however, the positioning pins for the developing units U are forcibly moved by the guides toward the direction for attachment or detachment, allowing the developing units U to be easily attached or detached.

As shown in FIG. 14, furthermore, the guide member 84 of the frame 12 has a turn-stop portion 84*d* for receiving the side portion of the optical head 40 when the tip of the optical head 40 is supported by the support portion 84*a*. The spring 86 is arranged at an angle relative to the axis of the mounting portion of the optical head 40 so that the spring 86 urges the optical head 40 toward the turn-stop portion 84*d*. Therefore, a predetermined focal distance can be maintained at all times, and the printing is favorably effected.

Figure 15:
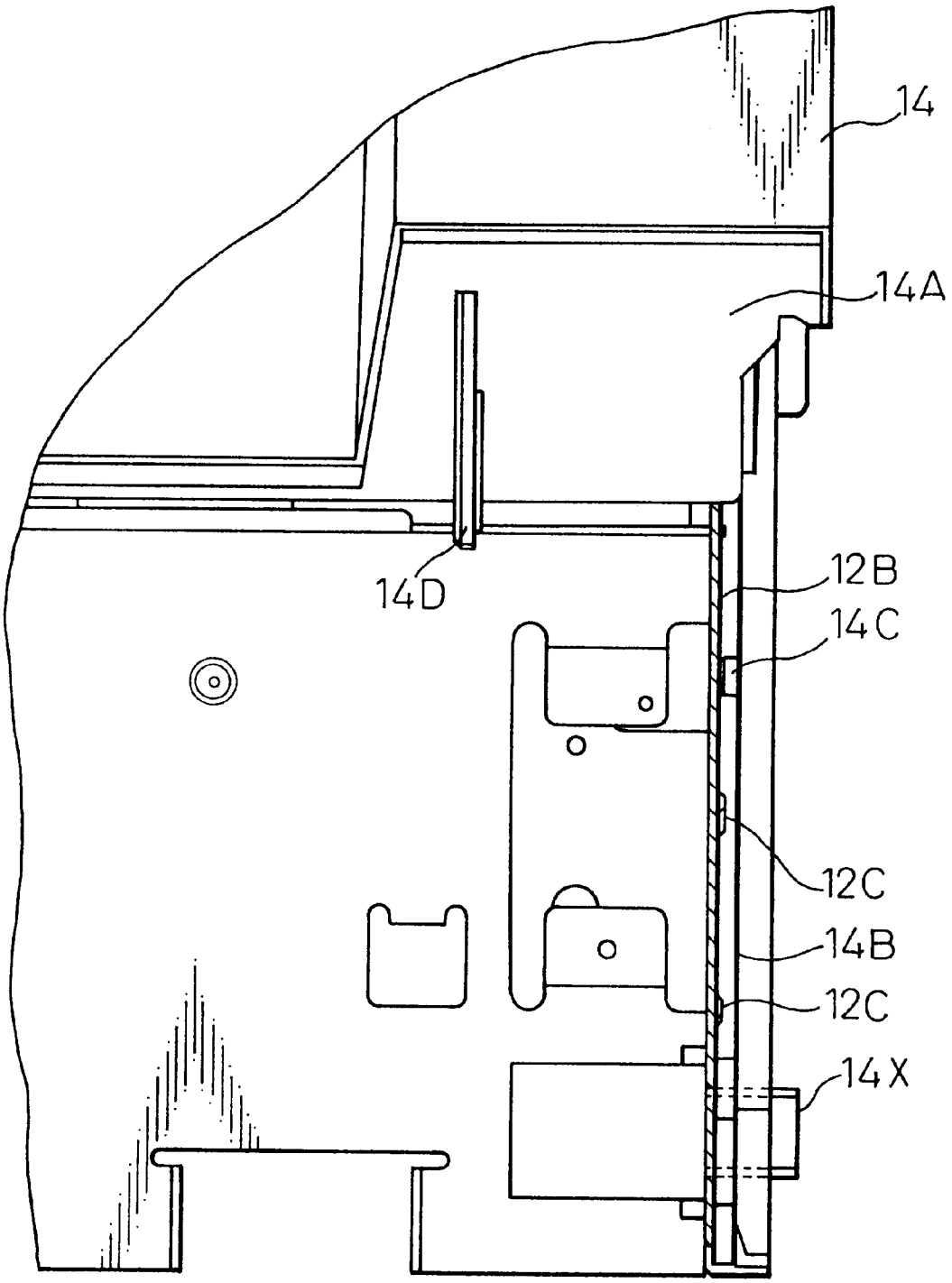
FIG. 15 is a view illustrating, in detail and on an enlarged scale, a portion of the side plate of the top cover of FIG. 6.

FIG. 15 is a view illustrating a portion of the apparatus of FIG. 6 in detail on an enlarged scale. In FIGS. 6 and 15, the top cover 14 has side plate portions 14B that extend rearwardly and downwardly from both sides of the cover portion 14A. FIG. 15 further shows side plate portions 12B of the frame 12. The side plate portions 14B of the top cover 14 vertically extend in parallel with the side plate portions 12B of the frame 12, and the rotary support point 16X comprises a shaft provided at the front ends of the side plate portions 14B and the side plate portions 12B. The side plate portions 14B of the top cover 14 have protuberances 14C that come into contact with the side plate portions 12B of the frame 12. The protuberances 14C are shown in FIG. 1 too. The side plate portions 14B of the top cover 14 easily undergo a deflection due to a force acting in a horizontal direction of the apparatus. Therefore, rigidity is imparted thereto by the provision of the protuberances 14C that come into contact with the side plate portions 12B of the frame 12. The protuberances 14C are located at positions away from the rotary support point 16X, making it possible to increase the length of the arms from the rotary support point 16X to the protuberances 14C to a suitable degree and to impart increased rigidity to the right and left of the top cover.

The side plate portions 12B of the frame 12 have rugged portions 12C that come into contact with the protuberances 14C of the side plate portions 14B of the top cover 14. In this embodiment, the rugged portions 12C are formed as two protuberances. As shown in FIG. 1, the protuberances 14C and rugged portions 12C are on a circle with the rotary support point 16X as a center. When the top cover 14 is opened, the protuberances 14C slide on the surfaces of the side plate portions 12B of the frame 12, ride over the first rugged portions 12C, slide on the surfaces of the side plate portions 12B of the frame 12 and, then, ride over the second rugged portions 12C. After the protuberances 14C have ridden over the second rugged portions 12C, the top cover 14 reaches the fully opened position.

Upon providing the protuberances 14C and rugged portions 12C as described above, load is produced at the time when the protuberances 14C ride over the rugged portions 12C accompanying the opening or closing motion of the top cover 14, and a click feeling is obtained in the operation. In particular, the (second) rugged portions 12C located at positions just before the top cover 14 reaches the fully opened position make it possible to learn that the top cover 14 has reached the fully opened position, and enable the top cover 14 to be maintained at the fully opened position. The top cover 14 (as well as parts mounted thereon) may tend to be vigorously closed as it falls due to its own weight when it is to be closed. However, with the (first) rugged portions 12C being located at positions at which the top cover 14 is likely to abruptly move, the top cover 14 is prevented from being suddenly closed. By providing at least one rugged portion at a position satisfying the relationship, the force causing the top cover 14 to turn and fall due to its weight<the force required for the protuberances 14C to ride over the rugged portions 12C, the top cover 12 is prevented from being suddenly closed, avoiding the danger that a hand is caught by the top cover 12 that is closing.

Referring to FIGS. 6 and 15, the top cover 12 has coupling portions 14D at a boundary portion between the cover portion 14A and the side plate portions 14B to couple the top cover 12 and the end cover 15 together.

Figure 16:
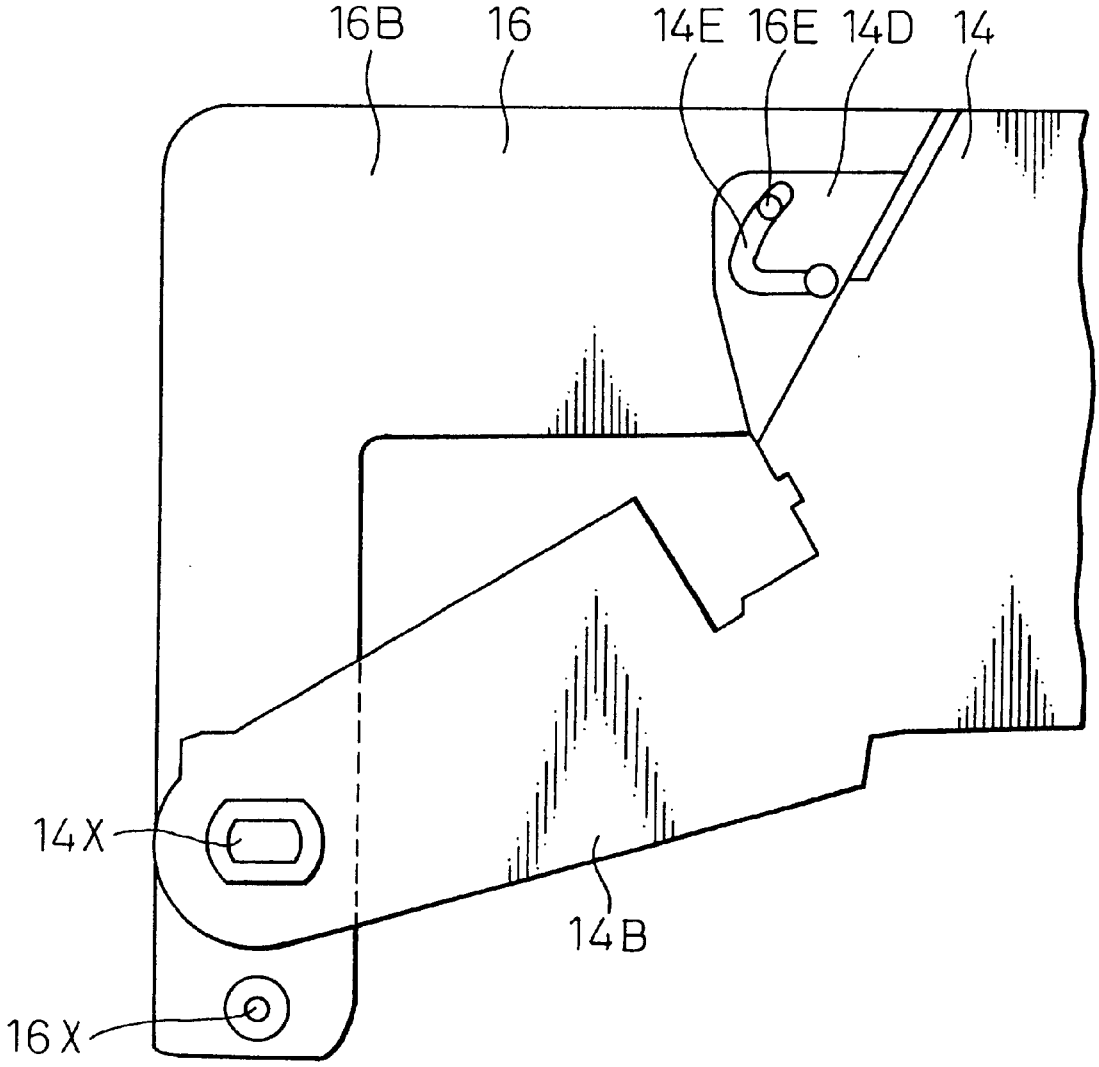
FIG. 16 is a view illustrating the relationship between the top cover and the end cover.

FIG. 16 is a view illustrating, on an enlarged scale, a portion of the apparatus of FIG. 1 in which the end cover 16 is added to the top cover 12. The end cover 16 includes a cover portion for covering the fixing device 32, and side plate portions 16B. The coupling portions 14D include coupling grooves 14E in an L-shape, and pins 16E extending from the side plate portions 16B of the end cover 16 are inserted in the coupling grooves 14E. When the top cover 14 and the end cover 16 are at the closed position, the pins 16E are located at the upper ends of the coupling grooves 14E. When the top cover 14 moves from the closed position to a slightly opened position, the pins 16E move along the vertical portions of the coupling grooves 14E, and the end cover 16 remains still. When the top cover 14 further mores, the pins 16E move along the horizontal portions of the coupling grooves 14E, and the end cover 16 moves together with the top cover 14. Thus, the end cover 16 permits the fixing device 32 to be repaired or replaced.

The guide provided independently for each of the printing assemblies makes it possible to decrease a change in the size thereof due to a rise in the temperature caused by heat produced by fixing and printing. This is particularly effective in regard to a focal distance that requires high dimensional precision.

In FIG. 1, under the paper conveyer belt 22 are provided an optical sensor 90 for reading marks printed on the paper conveyer belt, and a shut-off cover 92 which opens the optical passage of the optical sensor 90 when the apparatus is in operation and shuts off the optical passage of the optical sensor when the apparatus is not in operation. The optical sensor 90 will be described later.

The shut-off cover 92 moves by being linked to the opening or closure of the top cover 14. That is, the shut-off cover 92 is provided with a push lever 94 that comes into contact with an engaging portion 14F of the top cover 14 and a shutter lever 96 that comes into contact with the push lever 94. When the top cover 14 is closed, the push lever 94 pushes the shut-off cover 92 via the shutter lever 96; i.e., the shut-off cover 92 is moved toward a position to open the optical passage of the optical sensor 90. When the top cover 14 is opened, the push lever 94 returns the shut-off cover 92 via the shutter lever 96; i.e., the shut-off cover 92 is moved toward a position to shut off the optical passage of the optical sensor 90.

Figure 17:
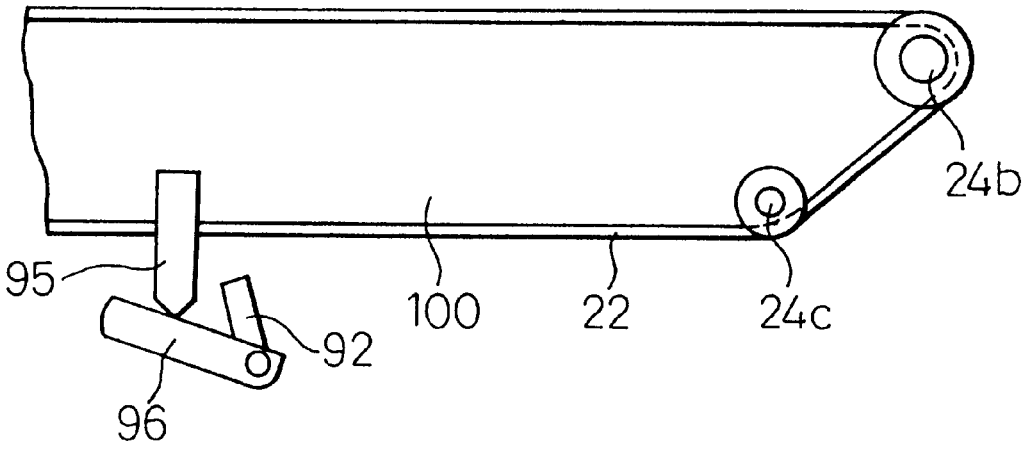
FIG. 17 is a view illustrating a modified example of a mechanism for moving the shut-off cover.

FIG. 17 is a view illustrating a modified example of the mechanism for moving the shut-off cover 92. In this example, provision is made of a push lever 95 that comes into contact with the belt unit 100 which jointly supports the paper conveyer belt 22, instead of providing the push lever 94 that comes into contact with the top cover 14. The push lever 94 moves the shut-off cover 92 via a shutter lever 96. The shut-off cover 92 shuts off or opens the optical passage of the optical sensor 90. The shut-off cover 92 can be driven by a drive means such as a motor or the like. Described below in detail is an example of using the push lever 94 that comes into contact with the top cover 14.

Figure 18:
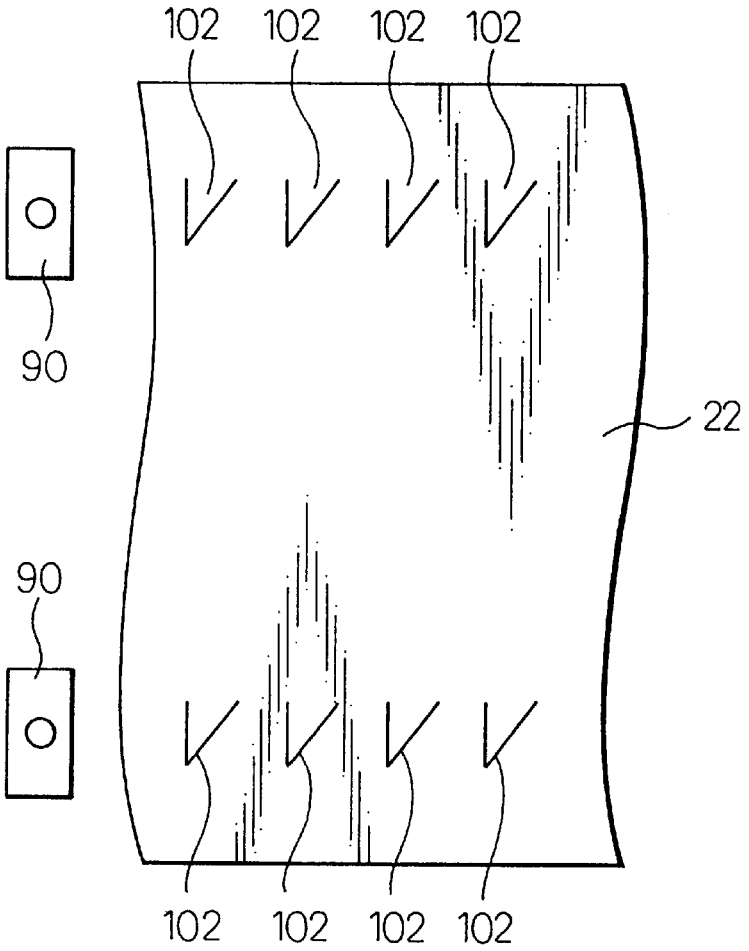
FIG. 18 is a view illustrating the paper conveyer belt and the optical sensor.

FIG. 18 is a view illustrating the paper conveyer belt 22 and two optical sensors 90. For example, at the start of use, the plurality of printing assemblies 20B, 20C, 20M and 20Y print marks 102 on the paper conveyer belt 22. The optical sensors 90 read the marks 102 printed on the paper conveyer belt 22, and a control means that is not shown adjusts the printing positions and printing timings of the plurality of printing assemblies based upon the marks 102 that are read out.

Figure 19:
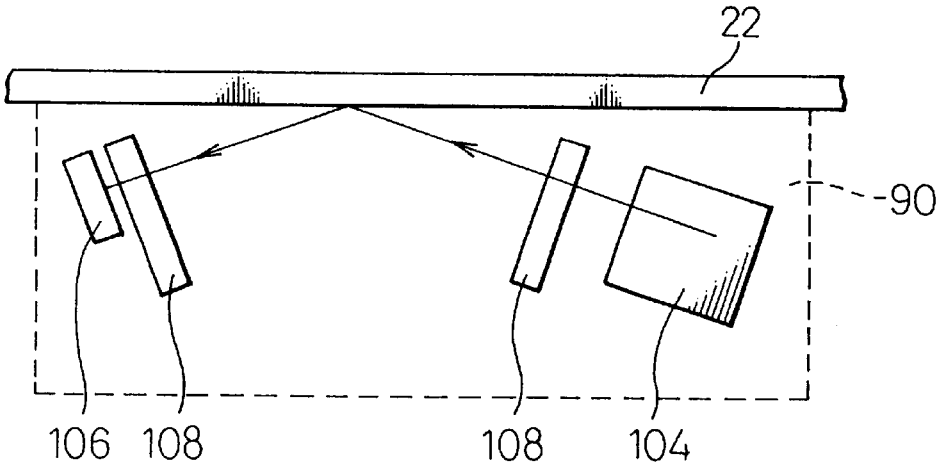
FIG. 19 is a view illustrating the operation of the optical sensor.

FIG. 19 is a view illustrating the operation of the optical sensor 90 which comprises a laser diode (L) 104 contained in a case, and a photodiode (PD) 106. A laser beam emitted from the LD 104 and reflected by the paper conveyer belt 22, is read by the PD 106. The laser beam of the optical sensor 90 may unexpectedly enter the eyes when the top cover 14 is opened or the belt unit 100 is lifted up while the power source circuit is closed, which is not desirable. It is therefore desired to shut off the optical passage of the optical sensor 90 being linked to the top cover 14 or to the belt unit 100.

In front of the LD 104 and PD 106, there are arranged dust-preventing members 108 which permit the transmission of the detection laser beam but prevent the infiltration of dust and dirt.

Figure 20:
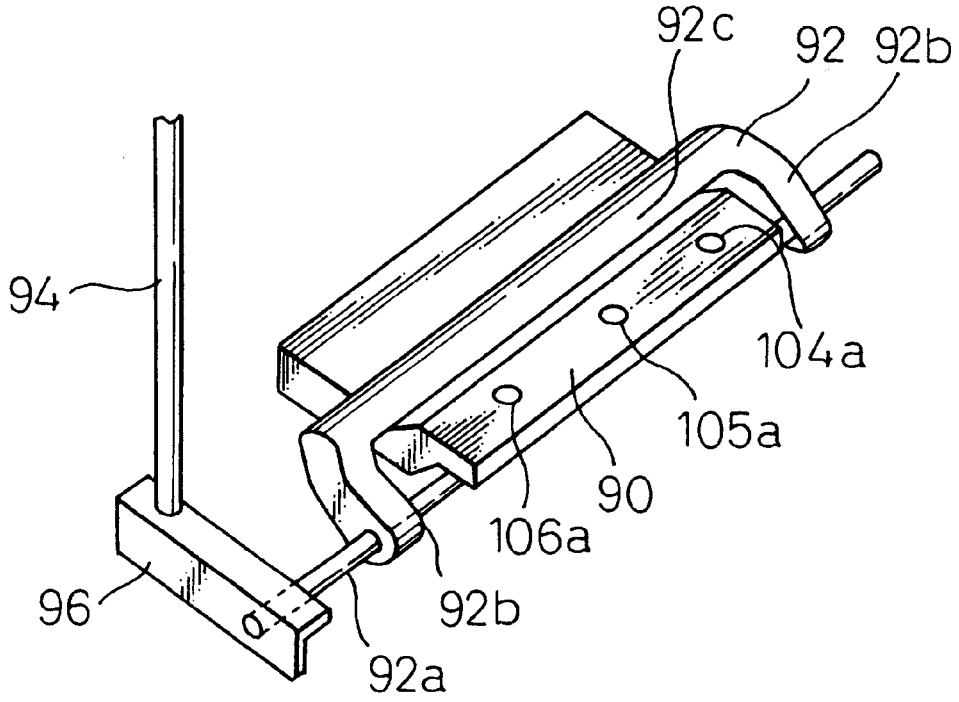
FIG. 20 is a perspective view illustrating the shutoff cover.
Figure 21:
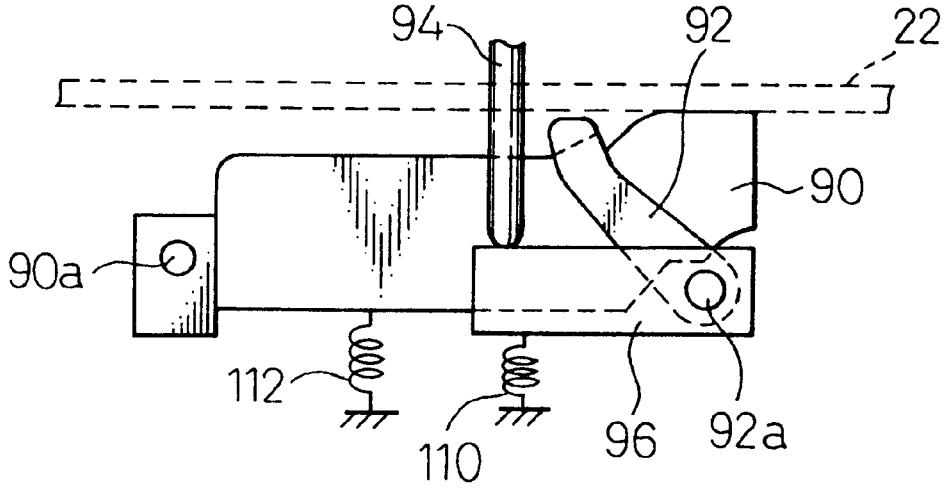
FIG. 21 is a side view of the shut-off cover of FIG. 21.

FIGS. 20 and 21 are views illustrating an example of the shut-off cover 92 which is secured to a support shaft 92*a*. The shutter lever 96, too, is secured to the support shaft 92*a*. The support shaft 92*a* is rotatably supported by the frame 12 through bearings that are not shown. A spring 110 upwardly urges the shutter lever 96 (or the shut-off cover 92).

The optical sensor 90 has optical openings 104*a* and 106*a* for the LD 104 and PD 106, and has another optical opening 105*a* at the center thereof. The optical opening 105*a* has no direct relationship to the present invention and is not described here. The optical sensor 90 is rotatably supported by the frame 12 through the support shaft 90*a* in parallel with the support shaft 92*a*. A spring 112 upwardly urges the optical sensor 90.

The shut-off cover 92 consists of a pair of arm portions 92*b* mounted to the support shaft 92*a* and a cover portion 92*c* extending between the pair of arm portions 92*b*. The cover portion 92*c* is disposed above the optical sensor 90, and is so located as to open the optical openings 104*a*, 106*a*, when the top cover 14 is closed, as shown in FIGS. 20 and 21. When the top cover 14 is opened, the push lever 94 is allowed to move, whereby the spring 110 causes the shutter lever 96 to turn upwards so that the shut-off cover 92 is turned in the clockwise direction. Thus, the cover portion 92*c* of the shut-off cover 92 covers the optical openings 104*a* and 106*a* thereby to shut off the optical passages of the optical sensors 90.

When the shut-off cover 92 turns clockwise in this embodiment, the cover portion 92*c* of the shut-off cover 92 covers the optical openings 104*a* and 106*a* while contacting (wiping) the surfaces of the optical sensors 90. The shut-off cover 92 includes a cleaning member such as a felt. In other words, the shut-off cover 92 is formed to work as a shutter as well as a cleaning member.

The optical sensor 90 is always urged onto the paper conveyer belt 22 by a spring 112. The optical sensor 90 is supported by the frame 12 in a floating manner. Therefore, the marks 102 are read out while a gap between the paper conveyer belt 22 and the LD 104 and PD 106 of the optical sensor 90 is maintained constant. When the shut-off cover 92 turns clockwise, the cover portion 92*c* of the shut-off cover 92 comes into contact with the surface of the optical sensor 90, and the optical sensor 90 is retracted from the paper conveyer belt 22.

The member for executing the retracting motion comes into contact with the housing of the optical sensor 90 earlier than the cleaning member, so that it moves back, and, then, the cleaning member makes contact. Accordingly, the material of the cleaning member can be selected from a wide range, and the reliability of operation is enhanced.

The shut-off cover 92 can be arranged to satisfy the North America Safety Standards (CDRH Standards of the FDA), by selecting a gap size and preventing the operator from erroneously operating the apparatus. Moreover, the shut-off cover 92 is urged at all times by an urging mechanism such as a spring in the direction to close the optical openings. In order to prevent irregular operation, the shut-off cover 92 is opened by using a highly rigid member such as a link mechanism linked to opening and closing the top cover 14, and is closed by a spring 110 or the like.

Figure 22:
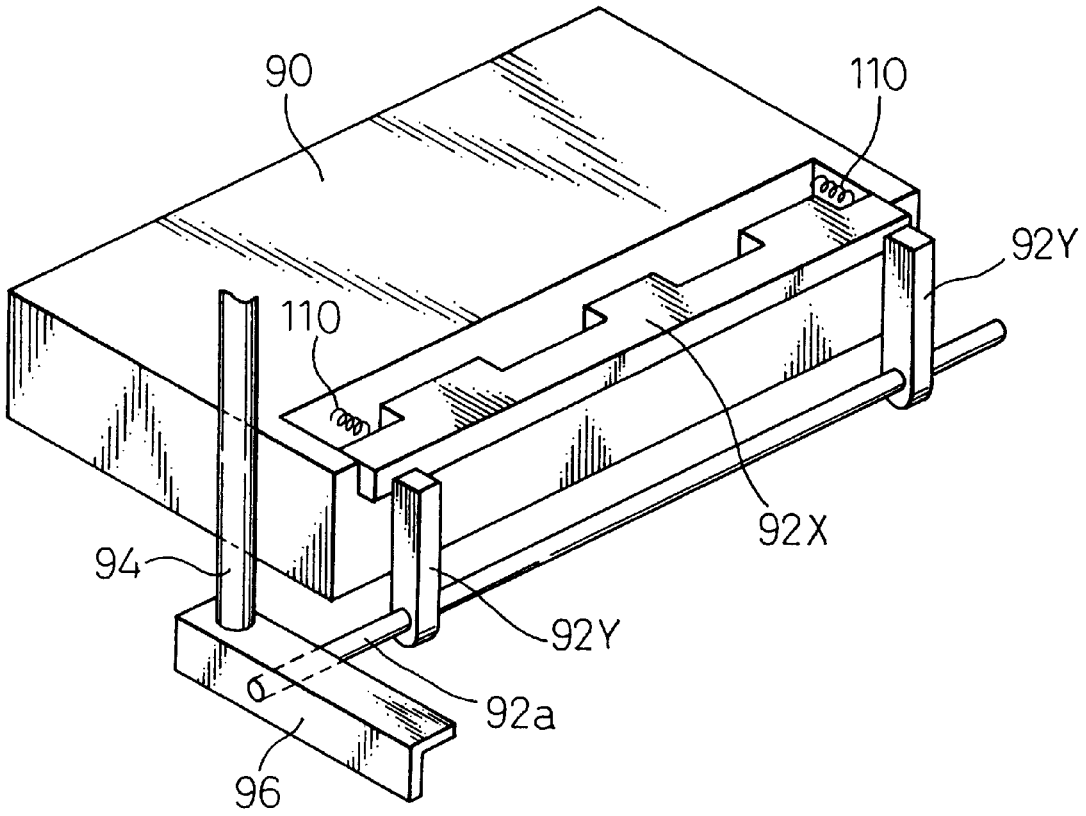
FIG. 22 is a perspective view illustrating another example of the shut-off cover.
Figure 23:
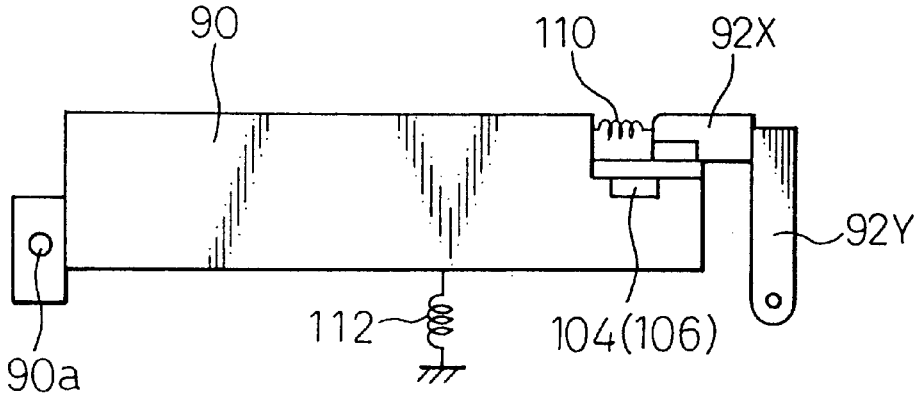
FIG. 23 is a side view of the shut-off cover of FIG. 22.

FIGS. 22 and 23 are views illustrating another example of the shut-off cover 92. In this example, the shut-off cover 92 is divided into a cover portion 92X and arm portions 92Y, and the cover portion 92X slides along a flat surface of the optical sensor 90. The arm portions 92Y are mounted to the support shaft 92*a* and are moved by the top cover 14 or the belt unit 100 via the push lever 94 and the shutter lever 96.

Figure 24:
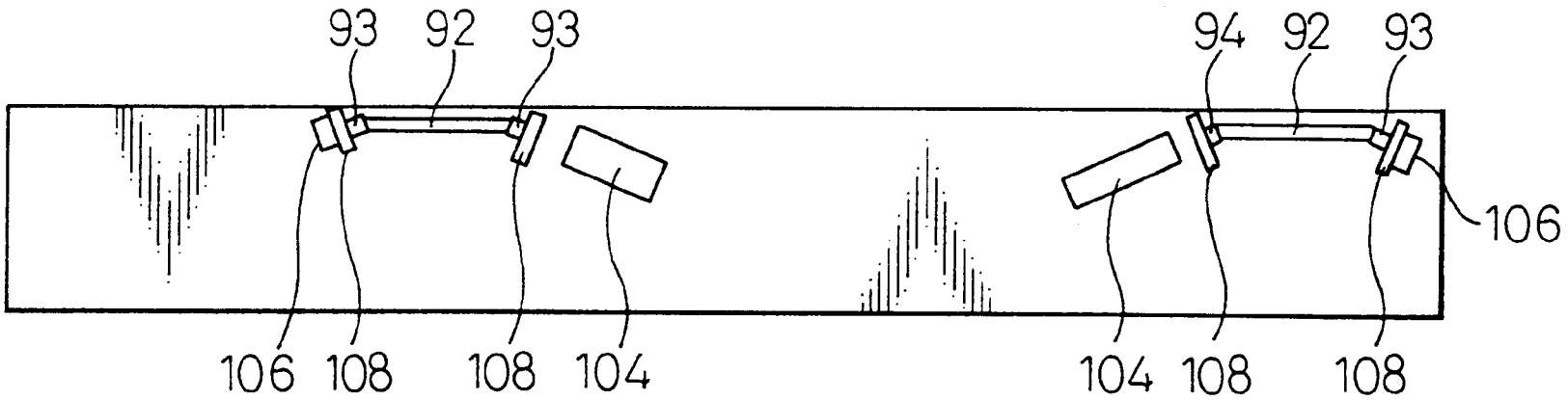
FIG. 24 is a view illustrating a further example of the optical sensor and the shut-off cover.

FIG. 24 is a view illustrating a further example of the optical sensor 90 and the shut-off cover 92. The optical sensor 90 has two pairs of LDs 104 and PDs 106, and is suited for reading two rows of marks 102 printed on the paper conveyer belt 22 as shown in FIG. 18. Dust-preventing members 108 are arranged on the surfaces of LDs 104 and PDs 106 to permit the transmission of the detection laser beams but to prevent the infiltration of dust and dirt. The dust-preventing members 108 are arranged in an arrangement corresponding to the top portions of "V". The shut-off cover 92 is arranged inside the pair of dust-preventing members 108 in the case of the optical sensor 90. The shut-off cover 92 shuts off the optical passage of the optical sensor 90, and has cleaning members 93 for wiping the surfaces of the dust-preventing members 108. The dust-preventing members 108 for the LD 104 and PD 106 can be formed of a single dust-preventing member.

Figure 25:
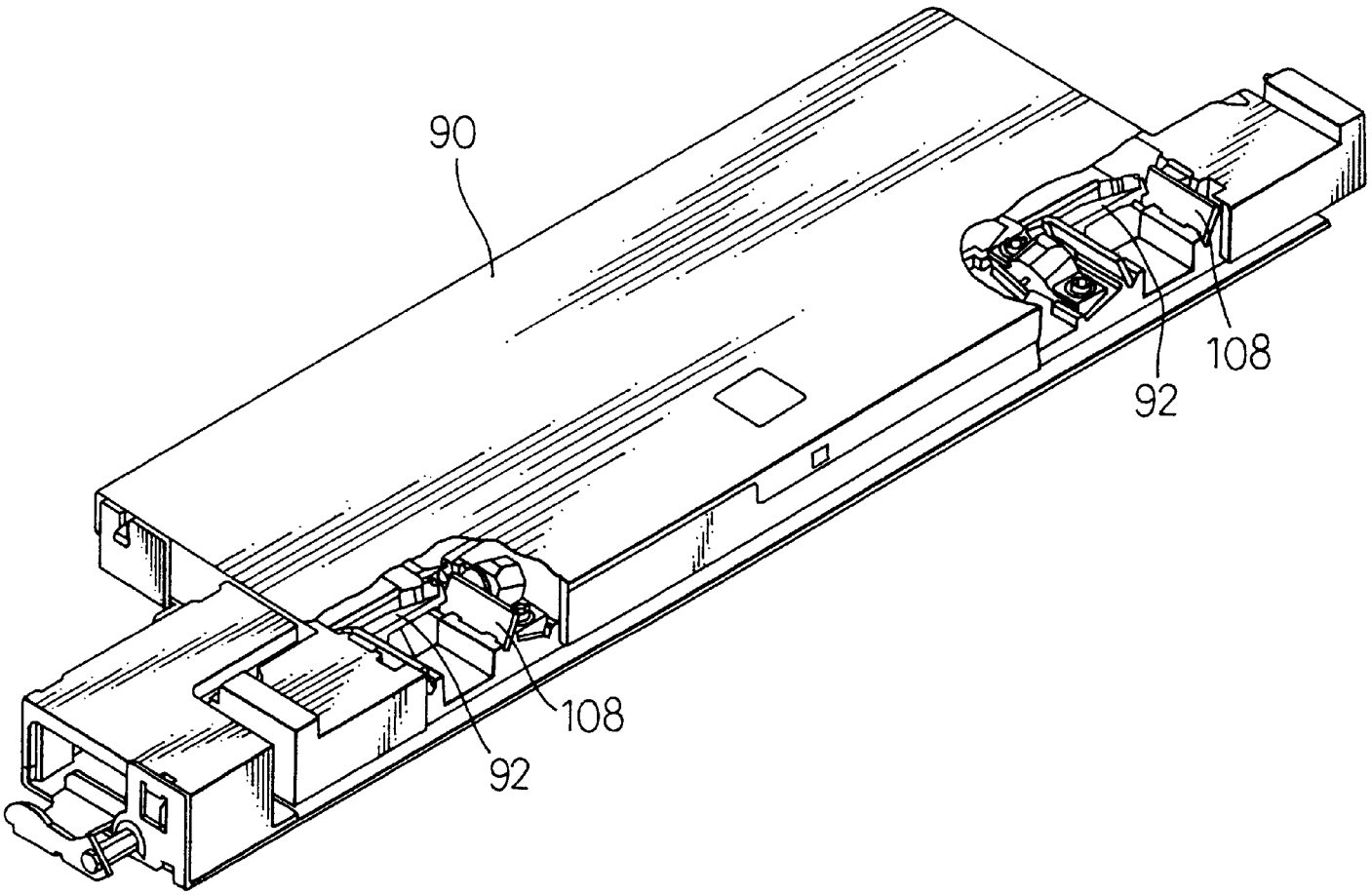
FIG. 25 is a partly cut-away perspective view illustrating, in detail, the optical sensor including the shut-off cover of FIG. 24.

FIG. 25 is a partly cut-away perspective view illustrating, in detail, the optical sensor 90 including the shut-off cover 92 of FIG. 24.

Figure 26:
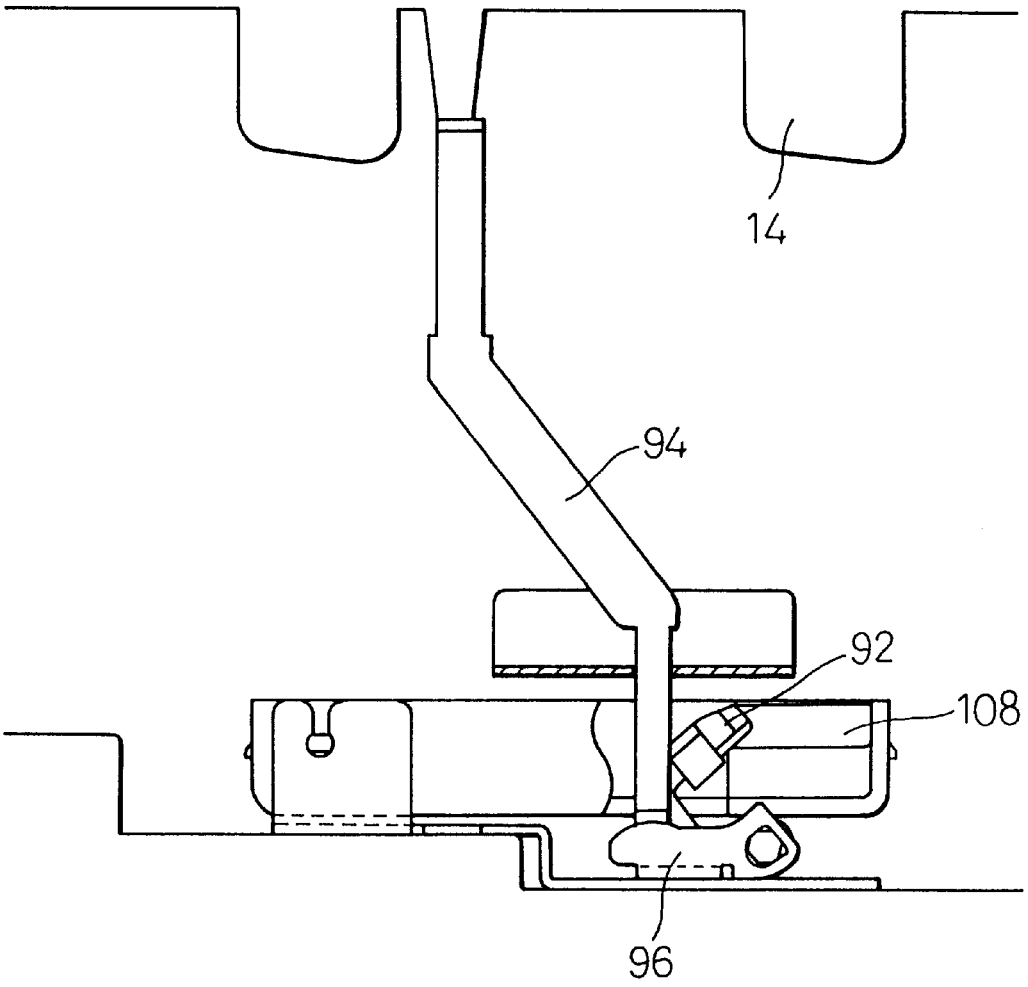
FIG. 26 is a view illustrating the shut-off cover of FIG. 25 at a position to open the optical passage.
Figure 27:
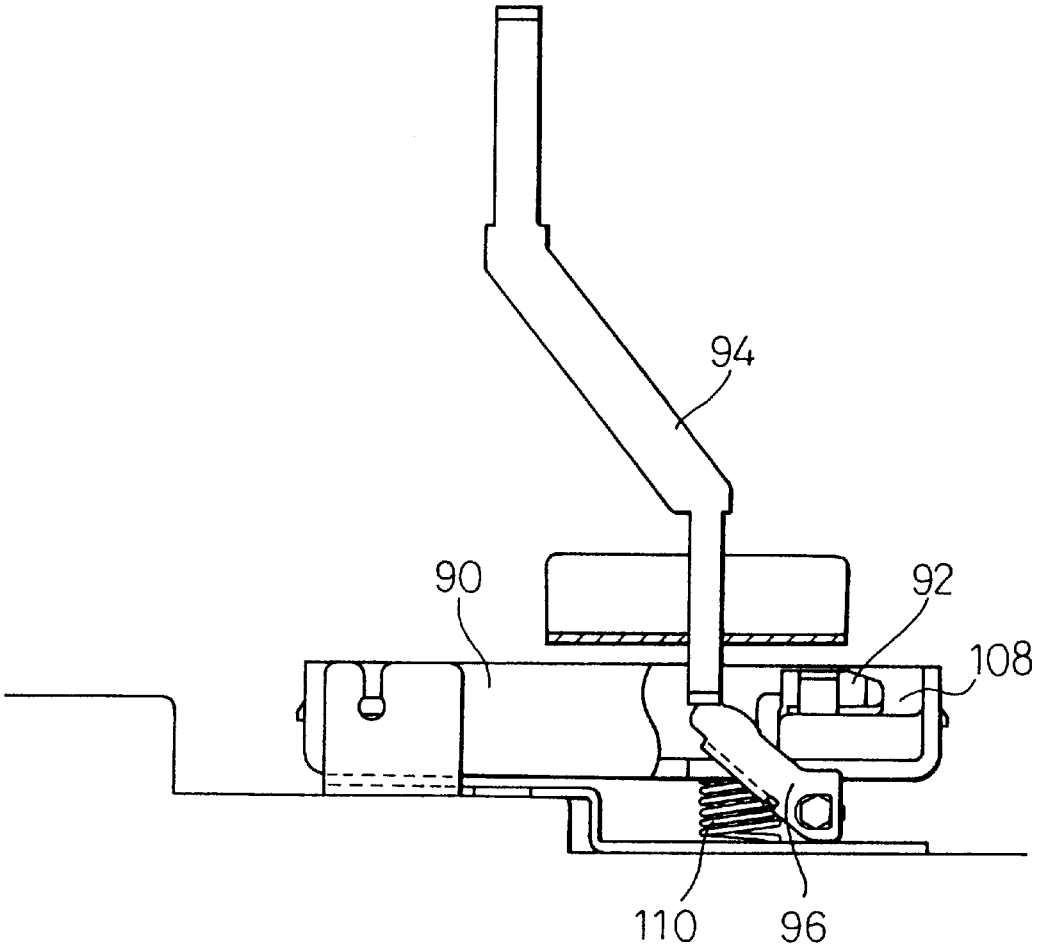
FIG. 27 is a view illustrating the shut-off cover of FIG. 25 is at a position to block off the optical passage.
Figure 28:
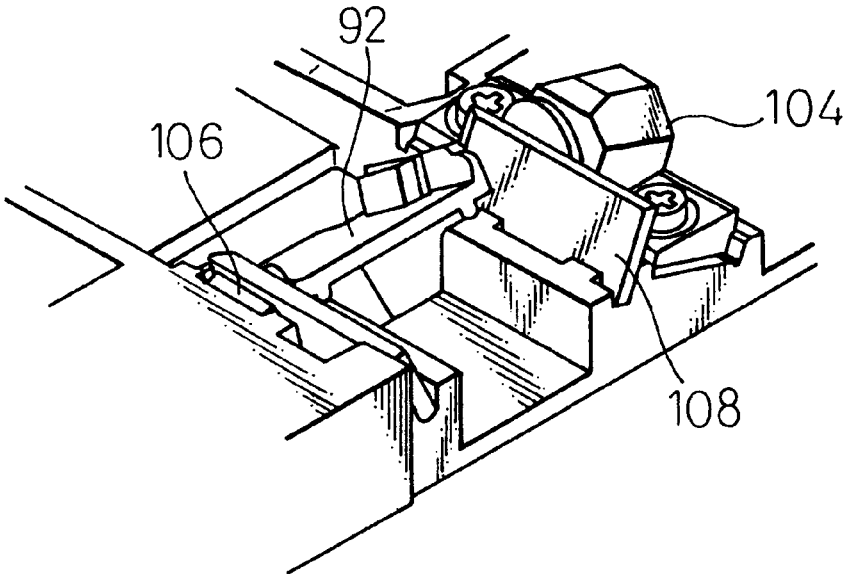
FIG. 28 is a view illustrating in detail the shutoff cover when it is not covering the dust-preventing member that defines the optical opening of the optical sensor.

FIGS. 26 and 27 are views illustrating the operations of the optical sensor 90 and of the shut-off cover 92 of FIG. 25. FIG. 26 shows the top cover 14 at the closed position, the shut-off cover 92 not covering the dust-preventing member 108 that defines the optical opening of the optical sensor 90. This state is best shown in FIG. 28. FIG. 27 shows the top cover 14 at the open position, the shut-off cover 92 being covering the dust-preventing member 108 that defines the optical opening of the optical sensor 90. This state is best shown in FIG. 29.

Figure 29:
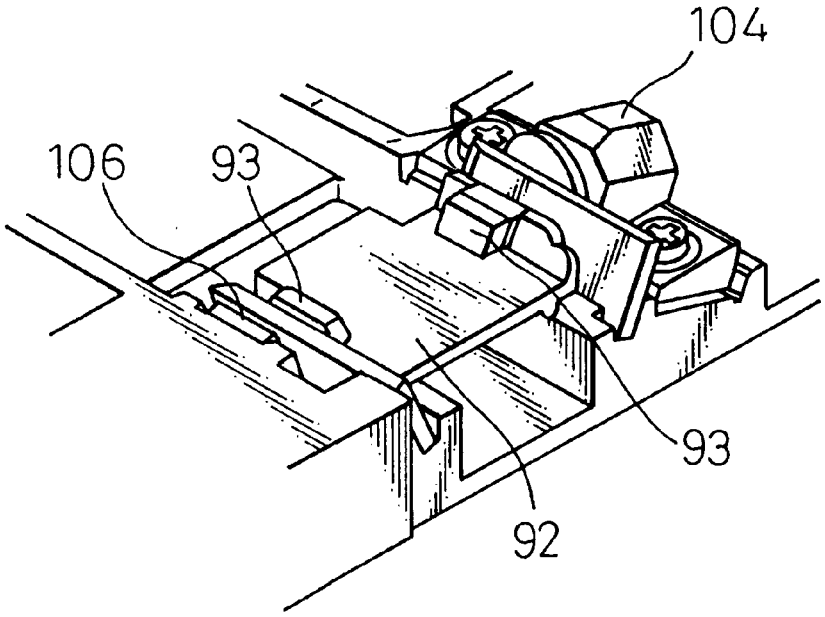
FIG. 29 is a view illustrating in detail the shutoff cover when it is covering the dust-preventing member that defines the optical opening of the optical sensor.
Figure 30:
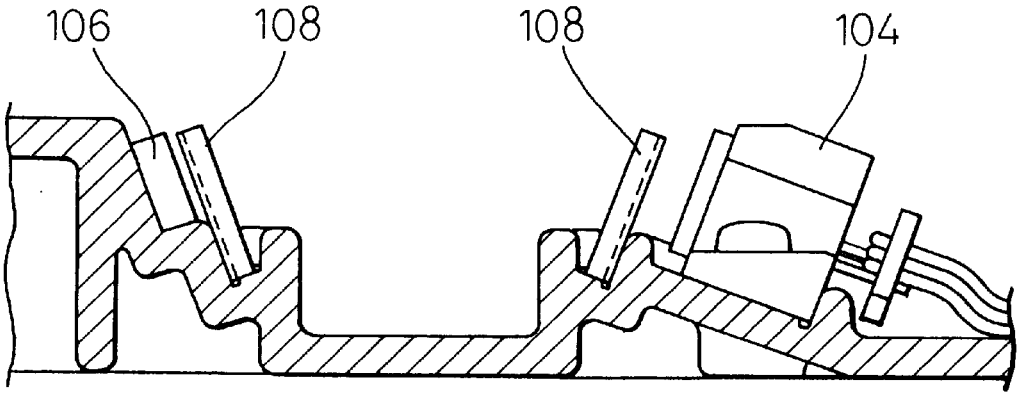
FIG. 30 is an enlarged view of the optical sensor of FIG. 28.
Figure 31:
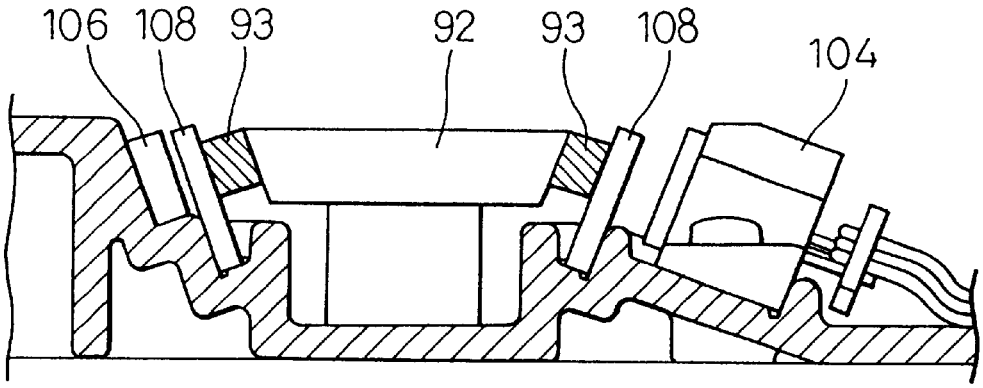
FIG. 31 is an enlarged view of the optical sensor and the shut-off cover of FIG. 29.

FIG. 30 illustrates the state of FIG. 28 in further detail, and FIG. 31 illustrates the state of FIG. 29 in further detail.

Figure 32:
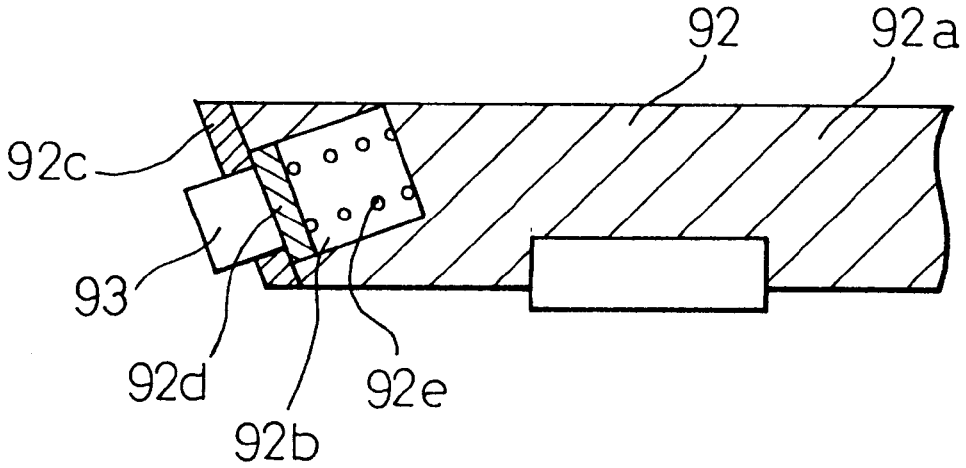
FIG. 32 is a cross-sectional view illustrating the shut-off cover in detail.

FIG. 32 is a cross-sectional view illustrating the shut-off cover 92 in detail. The shut-off cover 92 comprises a plate-like base member 92*a* having an end cavity 92*b*, a cap 92*c* adhered to the end of the base member 92*a*, a cleaning member 93 adhered to a support plate 92*d*, and a spring 92*e* disposed in the cavity 92*b*. The cleaning member 93 is brought to a protruding position by the spring 92*e* that urges the support plate 92*d*. The cleaning member 93 is a soft fibrous member suited for effecting the cleaning, such as a felt or a flannel.

According to the present invention, as described above, in the image forming apparatus equipped with a plurality of printing assemblies arranged in tandem it is possible to easily open and close the top cover which is large in size and is heavy in weight, and to reliably ensure precision for mounting the optical heads and the developing units. Since the top cover can be easily opened and closed, expendables can be easily replaced, and the apparatus can be easily checked during maintenance.

Since the shut-off cover is provided to shut-off the optical passage of the optical sensor, the laser beam does not leak to the exterior despite part of the apparatus is opened. Therefore, a person who is replacing the expendables or is checking the apparatus during maintenance is not irradiated with the laser beam and is not exposed to danger.

We claim:

1. An image forming apparatus comprising:

a frame;

a closing cover mounted to said frame so as to be opened and closed;

a plurality of printing assemblies each comprising a photosensitive body, a charger for charging said photosensitive body, an optical head for forming an electrostatic latent image on said photosensitive body, a developing device for developing said electrostatic latent image into a toner image, and a transfer element for transferring said toner image onto a paper;

a fixing device;

a paper conveyer belt for conveying paper through said plurality of printing assemblies;

an optical sensor having a light-emitting element and a light-receiving element to read marks formed on said paper conveyer belt; and a movable cover which opens an optical passage of said optical sensor when the apparatus is in operation and shuts off the optical passage of said optical sensor when the apparatus is not in operation.

2. An image forming apparatus according to claim 1, wherein said optical sensor includes a laser diode and a photodiode.

3. An image forming apparatus according to claim 1, wherein said optical sensor includes a dust-preventing member which permits a transmission of detection light but prevents an infiltration of dust and dirt.

4. An image forming apparatus according to claim 3, wherein said movable cover includes a cleaning member capable of cleaning said dust-preventing member.

5. An image forming apparatus according to claim 1, wherein said movable cover is urged by an urging member toward a direction to shut off the optical passage.

6. An image forming apparatus according to claim 1, wherein said optical sensor has a plurality of detector units, and said movable cover is capable of simultaneously covering said plurality of detector units.

7. An image forming apparatus according to claim 1, wherein said optical sensor is retracted from the paper conveyer belt being linked to said movable cover.

8. An image forming apparatus according to claim 1, wherein said optical sensor is supported in a floating manner by said frame.

* * * * *